US010718197B2

(12) United States Patent
Roodenburg et al.

(10) Patent No.: US 10,718,197 B2
(45) Date of Patent: Jul. 21, 2020

(54) WELLBORE DRILLING WITH A ROTATABLE HEAD CLAMP COMPONENT

(71) Applicant: ITREC B.V., Schiedam (NL)

(72) Inventors: Joop Roodenburg, Schiedam (NL); Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 16/309,813

(22) PCT Filed: Mar. 16, 2017

(86) PCT No.: PCT/NL2017/050165

§ 371 (c)(1),
(2) Date: Dec. 13, 2018

(87) PCT Pub. No.: WO2017/217839

PCT Pub. Date: Dec. 21, 2017

(65) Prior Publication Data

US 2019/0264514 A1 Aug. 29, 2019

(30) Foreign Application Priority Data

Jun. 15, 2016 (NL) ..... 2016971

(51) Int. Cl.
*E21B 44/00* (2006.01)
*E21B 3/02* (2006.01)
(Continued)

(52) U.S. Cl.
CPC ..... *E21B 44/00* (2013.01); *E21B 3/02* (2013.01); *E21B 19/008* (2013.01); *E21B 19/06* (2013.01);
(Continued)

(58) Field of Classification Search
CPC ..... E21B 19/008; E21B 19/06; E21B 19/08; E21B 19/10; E21B 19/16
See application file for complete search history.

(56) References Cited

U.S. PATENT DOCUMENTS 3,998,428 A * 12/1976 Miles ..... E21B 19/06 254/29 R
6,857,483 B1 2/2005 Dirks et al.
(Continued)

FOREIGN PATENT DOCUMENTS

EP 0 525 247 A1 2/1993
WO WO 2005/028808 A1 3/2005
(Continued)

OTHER PUBLICATIONS

Dutch Search Report, issued in Priority Application No. 2016971, dated Dec. 8, 2016.
(Continued)

*Primary Examiner* — Kristyn A Hall
*Assistant Examiner* — Dany E Akakpo
(74) *Attorney, Agent, or Firm* — Birch, Stewart, Kolasch & Birch, LLP

(57) ABSTRACT

In a wellbore drilling installation and method for drilling a wellbore or other wellbore related activities, the installation includes a drilling tower, drill floor with well center, and a slip device system including a first slip device and a second slip device. A top drive trolley with top drive device is guided along a vertical trolley rail. The trolley includes a frame and the top drive device is attached to the frame independent from first and second vertical frame members. A rotatable head clamp component is adapted to be releasably connected to and suspended from the first and second vertical frame members of the trolley. The rotatable head clamp component includes a housing, an open-centered rotary body, a drilling operation thrust bearing arranged
(Continued)

between the housing and the rotary body adapted to support the load of a drilling tubulars string during a drilling operation. The component further includes a retainer assembly that is embodied to axially retain the top end of the drilling tubular whilst the top end of the tubular remains accessible for the rotary stem of the top drive device. The installation is embodied such that, with both the first and second slip devices in their respective retracted position, the rotatable head clamp component is lowerable by the trolley into a position in between the first and second slip devices onto a support structure that is adapted to support the load of a drilling tubulars string retained by the rotatable head clamp component.

15 Claims, 21 Drawing Sheets

(51) Int. Cl.

| | |
|---|---|
| ***E21B 19/06*** | (2006.01) |
| ***E21B 19/00*** | (2006.01) |
| ***E21B 19/10*** | (2006.01) |
| ***E21B 19/16*** | (2006.01) |
| ***E21B 19/08*** | (2006.01) |
| ***E21B 15/00*** | (2006.01) |

(52) U.S. Cl.
CPC ..... *E21B 19/08* (2013.01); *E21B 19/10* (2013.01); *E21B 19/16* (2013.01); *E21B 15/00* (2013.01)

(56) References Cited

U.S. PATENT DOCUMENTS

| | | | |
|---|---|---|---|
| 2003/0159853 | A1 | 8/2003 | Archibald et al. |
| 2005/0173154 | A1 | 8/2005 | Lesko |
| 2012/0217066 | A1 | 8/2012 | Smith et al. |
| 2013/0090200 | A1 | 4/2013 | Richardson |
| 2013/0133900 | A1 | 5/2013 | Sredensek |

FOREIGN PATENT DOCUMENTS

| | | | |
|---|---|---|---|
| WO | WO 2006/059153 | A1 | 6/2006 |
| WO | WO 2014/178709 | A1 | 11/2014 |
| WO | WO 2014/182160 | A1 | 11/2014 |
| WO | WO 2014/193228 | A2 | 12/2014 |
| WO | WO 2015/133896 | A1 | 9/2015 |
| WO | WO 2015/143329 | A1 | 9/2015 |

OTHER PUBLICATIONS

International Search Report, issued in PCT/NL2016/050697, dated Dec. 14, 2016.
International Search Report, issued in PCT/NL2017/050165, dated Jun. 6, 2017.
Written Opinion of the International Searching Authority, issued in PCT/NL2016/050697, dated Dec. 14, 2016.
Written Opinion of the International Searching Authority, issued in PCT/NL2017/050165, dated Jun. 6, 2017.

* cited by examiner

WELLBORE DRILLING WITH A ROTATABLE HEAD CLAMP COMPONENT

FIELD OF THE INVENTION

The present invention relates to wellbore drilling installation with a trolley and a top drive device, e.g. mounted or adapted to be mounted on an offshore drilling vessel.

BACKGROUND OF THE INVENTION

In WO2014/182160 an offshore vessel with a wellbore drilling installation is disclosed which comprises:

- drilling tower,
- a drill floor having a well center through which a drilling tubulars string can pass along a firing line,
- at least one vertical trolley rail supported by the drilling tower,
- a trolley, said trolley being guided along said at least one vertical trolley rail,
- a main hoisting device adapted to move the trolley with the top drive device up and down along said at least one vertical trolley rails, and
- a top drive device attached to the trolley, said top drive device comprising one or more top drive motors, e.g. electric top drive motors, and a rotary stem extending in the firing line and being driven by said one or more motors in order to impart rotary motion to a drilling tubulars string when connected to said top drive.

In WO2014/178709 a wellbore drilling installation is disclosed wherein the trolley comprises a frame with a top frame member suspended from one or more winch driven cables of a main hoisting device, and with first and second vertical frame members that are each connected at an upper end thereof to the top frame member. These first and second vertical frame members depend from the top frame member at locations that are spaced apart from one another. The top drive device is attached to the frame via bails that are attached to the gearbox of the top drive and a hook arrangement on the top frame member. Thereby the top drive device is supported by the frame independent from the first and second vertical members. These first and second vertical members carry at their lower ends a cross beam which supports, in an embodiment, a rotatable tubular stem via a drilling operations thrust bearing. The stem is adapted to be connected, via a threaded portion at its lower end, to the top end of a drilling tubulars string that passes along the firing line into the wellbore. The top drive device is connectable to the upper end of the tubular stem so that drilling can be performed by rotating the drilling tubulars string. The load of a drilling tubulars string is transmitted via the thrust bearing and the cross beam to the first and second vertical frame members and thereby to the top frame member that is suspended from the main hoisting device.

In WO2014/193228 a wellbore drilling installation for drilling a wellbore or other wellbore related activities is disclosed, which installation comprises a slip device system recessed in the drill floor with a first slip device and a second slip device, each adapted to clamp onto and support the load of a drilling tubulars string. Each slip device is movable between an operational position aligned with the firing line and a respective retracted position remote from the firing line. These respective retracted positions are on opposite sides from the firing line. Each of the first and second slip devices has a lateral opening allowing to disengage the slip device in its operational position from a drilling tubulars string in the firing line and move the slip device into its respective retracted position and vice versa.

OBJECT OF THE INVENTION

The present invention aims to propose measures that allow for enhanced drilling efficiency, e.g. in view of the use of so-called tapered drilling tubular strings. The present invention also aims to propose measures that allow to reduce the downtime due to top drive failure and/or to soften the impact of top drive failure on the drilling process. The present invention may also contribute to more efficient wellbore activities, e.g. exchanging one top drive device for another top drive device, efficient switching between drilling and tripping (out), efficient drilling with casing, etc.

SUMMARY OF THE INVENTION

According to a first aspect thereof the invention provides a wellbore drilling installation for drilling a wellbore or other wellbore related activities.

The head clamp component is primarily envisaged for use during a drilling process, wherein the drilling tubulars string is suspended from the head clamp component and the top drive device has its motor driven rotary stem connected to the top end of the string to provide torque to the string, e.g. a drill pipes string or a casing string.

It is envisaged, at least in suitable embodiments, that the same head clamp component may also be used during tripping in or out a drilling tubulars string, advantageously allowing to dispense with the presence and use of any tubulars elevator to be mounted on the trolley and/or the top drive device.

For example for tripping out a drilling tubulars string the trolley can be lowered so that the top end of the string, held by a slip device, e.g. on or in the drill floor, passes into the open centered rotary body and is then retained by the retainer assembly, e.g. as pivotal retainer members are pivoted to allow for the passage of a tool joint or box member at said top end upward past said retainer members and then the pivotal retainer members move or are moved back to a retaining position wherein they engage on, e.g. below, a shoulder of the tool joint or box member.

Instead of pivoting other motions of the retainer members can be envisaged as well. There is no need to connect the top drive device to the string in tripping operations, in fact in an embodiment the top drive device is removed from the trolley in order to reduce the weight of the trolley and so increase effective hoist capacity of the main hoisting device and/or to perform service on the top drive device removed from the trolley during a tripping run. Then the trolley is hoisted so as to pull a stand of the drilling tubulars out of the wellbore. The slip device is then reengaged with the string and a piperacker device is operated to grip the raised stand, which is then released at its lower end from the string and is released from the head clamp component. The released stand is than moved into a storage device or rack for tubular stands by means of the racker device. For tripping in a string into the wellbore the same equipment can be used in reverse manner.

The rotary head clamp component may also be used for other activities, e.g. for handling a telescopic joint, a bottomhole assembly, etc. as its load carrying capacity is enormous due to the requirement that it can support the load of the drilling tubulars string.

In practical embodiments the rotary head clamp component may be embodied to handle a vertical load of at least 500 tonnes, or even at least 1000 tonnes, or even at least 1500 tonnes exerted thereon by a drilling tubulars string whilst said string is rotated by the top drive device in a drilling operation.

The head clamp component may comprise a built-in lubricating system for at least the thrust bearing and/or a monitoring system for at least the thrust bearing, e.g. to monitor effective load and/or wear and/or temperature of the thrust bearing.

In an embodiment the installation comprises:

- a first rotatable head clamp component adapted or set to handle first diameter drilling tubulars having a first diameter, and
- a second rotatable head clamp component adapted or set to handle second diameter drilling tubulars having a second diameter different from said first diameter, and, preferably, additional link members, e.g. solid (e.g. forged) link members or chains, adapted to suspend one of said first and second rotatable head clamp components from the other of said first and second rotatable head clamp components. As will be explained herein, the provision of these elements for example allows to efficiently operate a tapered drill string process.

In an embodiment the head clamp component has a rotary body supported by a thrust bearing, wherein the vertical passage is provided with an internal locking formation, e.g. a bayonet lock formation, adapted to cooperate with a mating external locking formation of a firing line tool. The tool may e.g. be a quill with threaded lower end, a casing tool, a spear tool, etc. This embodiment envisages the presence of a plurality of different tools being equipped with the same external locking formation, so that a selected tool can be connected to the rotary body, e.g. in a bayonet locking arrangement. In an embodiment the rotary body of the rotatable head clamp as described herein is also provided with an internal locking formation allowing for dual use of the head clamp component.

In embodiments the one or more components further comprise one or more of:

- a casing tool including an internal and/or external gripper assembly for gripping casing,
- a casing running tool,
- a casing drive tool, e.g. a casing drive tool that is connectable to the top drive device that provides the rotary power to the casing drive tool,
- a riser lifting tool adapted for use in upending of a riser section to be added to a riser string and/or for lifting an lowering a riser string in subsea wellbore related activities,
- a well intervention apparatus, e.g. including a coiled tubing injector, e.g. a structural frame provided with a coiled tubing injector apparatus, e.g. a multistory structural frame with one or more pressure control devices (BOP's) at a lower level, a coiled tubing injector at a higher level.

It will be appreciated that the above list is non-limiting and that other components used in the drilling industry in the firing line, e.g. above the well center, may also be provided.

In an embodiment the installation comprises one or more carts, each adapted to transport a component to be suspended from the first and second vertical frame members, wherein each cart is adapted to be positioned on the drill floor underneath the trolley, e.g. over the well center. This may for example allow to operate the installation for a removal of a component suspended from vertical load bearing frame members by a routine including the steps of:

- positioning a cart on the drill floor underneath the trolley,
- lowering the trolley by means of the main hoisting device and bringing the component to rest on the cart,
- releasing the component from vertical load bearing frame members,
- moving away the cart with the released component to a remote location.

The provision of one or more carts may also allow for the mounting of a component to be suspended from the vertical load bearing frame members of the trolley by a routine including the steps of:

- moving a cart carrying the component from a remote location to a position on the drill floor underneath the trolley,
- coupling said component with the vertical load bearing frame members,
- lifting the component from the cart, e.g. by raising the trolley,
- moving the empty cart to a remote location.

In an embodiment the cart(s) is/are embodied to travel over rails on the drill floor and, e.g. in practical embodiments in an offshore drilling vessel, said rails also may extend over an adjoining deck area of the vessel. For example the rails form part of a grid of orthogonal rail sections that have junctions connecting the rail sections, e.g. a first cart rail section includes a pair of parallel cart rails passing along the well center of the drill floor, and a second cart rail section that is orthogonal to said first cart rail section. For example said first cart rail section extends transverse to the hull of a monohull drilling vessel and the second cart rail section extends along a side of the hull. Other arrangements are also possible.

The drill floor may e.g. extend over a moonpool in an offshore drilling vessel. In an embodiment the drill floor is movable, e.g. vertically by suspending the drill floor from the trolley (e.g. by connecting to said first and second vertical frame members), e.g. to allow a BOP or other subsea equipment to be brought into the moonpool while the drill floor is in a raised position. The drill floor may thus be provided with connectors that are adapted to mate with the lower connectors of the first and second vertical frame member of the trolley. In another embodiment the drill floor is pivotal or horizontally slidable in order to open the moonpool for access of the BOP or other large subsea equipment into the moonpool.

In an embodiment the main hoisting device includes a heave compensation system, e.g. a heave compensation mechanism is provided that acts on one or more cables from which the trolley is suspended relative to the drilling tower in order to afford heave compensation of the trolley and any attached components, including the attached top drive device. Heave compensation may be passive and/or active as is known in the art. In view of effective height it is preferred for any heave compensation system to be located between the one or more winches and the crown block, and/or be embodied as control of the respective winch or winches, when such main hoisting device is present, so as to allow maximum travel of the trolley up to the crown block, e.g. in view of handling tall stands of tubulars, e.g. stands of 4, 5, or even six tubular joints (e.g. 180 ft. stands). So it is preferred that no heave compensation device is present in or on the trolley, e.g. between a travelling block and the trolley. Such arrangements would take up height in undesirable manner.

As will be explained herein, in embodiments, the trolley and top drive device may be embodied to allow for some operational vertical motion of the top drive device relative to the trolley frame during operational use, e.g. in view of make-up and break-up of a (screw threaded) connection between a rotary stem or quill of the top drive device and the top end of the drilling tubular axially retained by a rotatable head clamp. For such operations a vertical travel range of e.g. at most 1 meter will suffice in practice.

A cart for transporting a component and/or the top drive device may be embodied as a skid cart travelling over skid rails, e.g. with a skid mechanism to advance the cart. A skid cart embodiment is, for example, advantageous in combination with the handling of the top drive device by means of such a cart, taking into account the significant weight and size of a top drive device, e.g. in offshore (deep water) drilling. Similar reasoning applies when it is envisaged that one or more tall and heavy firing line components are to be suspended from the trolley, e.g. a multistory structural frame provided with a coiled tubing injector and, at a lower level, one or more pressure control devices, possibly also with a wireline unit. Such tall multistory structural frames can be handled by a skid cart.

One or more of the carts may be designed dedicated to a specific component to be transported by the cart, e.g. a dedicated top drive device cart, a dedicated rotatable head clamp component cart, a dedicated wrench device cart, etc. For example the cart has a cradle which is shaped or embodied to receive therein the specific component.

In an embodiment the frame of the trolley and the top drive device are provided with one or more cooperating vertical guide members so that the top drive device is vertically displaceable and guided relative to the frame of the trolley, wherein the top drive device has an operative position above a component, e.g. the mentioned rotatable head clamp component, held by the one or more vertical load bearing frame members.

One or more vertical guide members on the trolley frame for the top drive device may be embodied such that removal of the top drive, e.g. in view of mere removal, servicing, and/or exchange of the top drive device, is allowed or performed by a routine comprising the steps of:

- positioning a cart on the drill floor underneath the trolley,
- lowering the trolley by means of the main hoisting device and bringing the component to rest on the cart,
- releasing the component from the vertical load bearing frame members,
- moving away the cart with the released component resting thereon to a remote location,
- positioning a cart on the drill floor underneath the trolley,
- lowering the top drive device relative to said frame of said trolley until one or more cooperating vertical guide members thereof disengage and the bringing the top drive device to rest on the cart,
- moving the cart with said lowered and disengaged top drive device resting thereon to a remote location, e.g. to a remote service and/or storage location. Preferably two carts are used in this routine, e.g. one cart dedicated to the component and one cart dedicated to handling and transporting the top drive device.

Vertical guidance of the top drive by the frame of the trolley allows for easy and fast handling and to control the very heavy top drive during its descend, also during its raising when installing the top drive, e.g. onboard a drilling vessel that is subjected to sea state induced motions, e.g. roll, pitch, heave. In embodiments the same vertical guide arrangement also is embodied as a reaction torque absorber, e.g. for the top drive device, the wrench device, and/or the component that is suspended from the first and second vertical frame members. The latter version avoids undue loading of the vertically strained first and second vertical frame members by additional torque and/or avoids undue torsional load on the releasable connection between the component and these frame members.

In embodiments the top drive device is vertically displaceable relative to the frame of the trolley, e.g. guided by one or more cooperating guide members, wherein the trolley is provided with an auxiliary hoisting device adapted to vertically move at least the top drive device relative to the frame. For example the auxiliary hoisting device is adapted to lower the top drive device onto a cart positioned on the drill floor underneath the trolley in the course of removal of the top drive device and to lift the top drive device from a cart positioned on the drill floor underneath the trolley in the course of mounting of the top drive device in the trolley. This will require an auxiliary hoisting device having a capacity corresponding at least to the weight of the top drive device. The auxiliary hoisting device may be permanently fitted on the trolley, so as to be readily available when needed. For example one or more chain or wire hoist devices can be provided on the trolley, having a capacity to handle the top drive device.

For example it is envisaged that a method comprises the step of lowering the rotatable head clamp component whilst supporting a drilling tubulars string onto the support structure in or on the drill floor, and the later step of positioning a cart on the drill floor over the well center and underneath the trolley, so over the rotatable head clamp component and the drilling tubulars string retained by said component. This is for example advantageous in an embodiment wherein the support structure is arranged with a recessed well center, so that the rotatable head clamp component and upper end of the drill string held thereby does not, or in a limited extent, protrude above the drill floor.

In an embodiment, with the cart being positioned over the well center and the rotatable head clamp component and the drilling tubulars string retained by said component, the method comprises the step of disconnecting the top drive device from the trolley and arranging the top drive device onto the cart, as well as the step of moving the cart with the top drive device away from the well center, e.g. to a remote storage and/or repair position.

In embodiments the one or more vertical load bearing frame members comprise, or as preferred are constituted by, first and second vertical frame members. In preferred embodiments the first and second vertical frame members are embodied each as a pivotal link member of which the upper end is pivotally connected to the top frame member so that the pivotal link members are pivotal in a common transverse plane that encompasses the firing line. For example each link member has an eye as lower connector member and one or more of the components have opposed hooks that are each engageable with a respective eye of the link member. The pivotal arrangement e.g. allows for easy engagement with a hook on the component and/or allows for the combination with components that have different widths between the respective hooks by placing the link members at varying angular positions. In embodiments the trolley may be equipped with one or more actuators that are adapted to cause controlled pivoting of the first and second vertical frame members, e.g. independent from one another, e.g. in view of connecting and disconnecting a component.

In embodiments the frame of the trolley has one or more vertical guide rails, wherein the top drive device has cooperating guide members, e.g. rollers, that cooperate with the one or more vertical guide rails, wherein one or more of said components comprise a guidance portion that cooperates with said same one or more vertical guide rails, e.g. said one or more vertical guide rails also being embodied to absorb reaction torque of said top drive device and/or of said one or more components equipped with said guidance portion. This dual use of the one or more vertical guide rails e.g. allows for a simpler and lighter structure of the trolley.

In embodiments the installation comprises a pair of parallel vertical trolley rails and the trolley comprises a rigid frame structure having an upper and lower trolley beam, which beams are vertically spaced from another, e.g. each beam being in view from above in V or U shape, and which beams are each equipped at ends thereof with rollers engaging the respective trolley rails. Herein the upper and lower trolley beams are rigidly interconnected by one or more rear frame members, e.g. a single rear frame member as is preferred. Further the rigid frame structure comprises a forward cantilevered frame member extending forward from a top end of said one or more rear frame members. Herein the forward cantilevered frame member carries a transverse horizontal top frame member in a transverse plane that encompasses the firing line. The first and second vertical frame members are each connected at an upper end thereof to said top frame member and depend from said top frame member spaced apart from one another, preferably in said transverse plane, and are adapted to support the load of a drilling tubulars string that passes along said firing line into the wellbore.

In an embodiment the trolley frame exactly has the first and second vertical frame members in order to support the one or more components, e.g. said vertical frame members each having an eye and the component having a pair of opposed hooks, e.g. forged steel hooks, that are engageable with said eyes. Herein, as preferred, stability of the component is enhanced by the component having a guidance portion, e.g. extending to the rear, that cooperates with a vertical guide rail on the trolley. For example said guide rail extends to below the eyes of the first and second frame members so that the component is still connected to the guide rail when the frame members are detached from the component, e.g. by pivoting each frame member laterally away from the respective hook.

In an embodiment the top frame member is provided with connectors, for example holes, for connecting thereto a series of cable sheaves in a side by side arrangement, wherein the drilling tower is provided with a crown block having cable sheaves so that the trolley is suspended by one or more winch driven cables in a multiple fall arrangement.

In embodiments the trolley is further provided with a wrench and/or clamp device that is mounted on the frame of the trolley independent from the top drive device and from the component held by the first and second vertical frame members, at a location below the top drive device and above said component. Preferably the frame of the trolley has one or more vertical guide rails and the top drive device has cooperating guide members, e.g. rollers, that cooperate with the one or more vertical guide rails.

In embodiments the wrench and/or clamp device is vertically guided on said same one or more vertical guide rails as the top drive device, e.g. allowing a routine for removal of the top drive device comprising the steps of:

positioning a cart on the drill floor underneath the trolley, lowering the trolley by means of the main hoisting device and bringing the component to rest on the cart, releasing the component from the lower connector members of the first and second vertical frame members, moving away the cart with the released component resting thereon to a remote location, positioning a cart on the drill floor underneath the trolley, lowering the wrench and/or clamp device relative to the frame of said trolley until said wrench and/or clamp device disengages from said one or more vertical guide rails and the bringing the wrench and/or clamp device to rest on the cart, moving the cart with said lowered and disengaged wrench and/or clamp device resting thereon to a remote location, e.g. to a remote service and/or storage location, positioning a cart on the drill floor underneath the trolley, lowering the top drive device relative to said frame of said trolley until said top drive device disengages from said one or more vertical guide rails and the bringing the top drive device to rest on the cart, moving the cart with said lowered and disengaged top drive device resting thereon to a remote location, e.g. to a remote service and/or storage location.

In embodiments at least one of the carts is embodied with a straddling structure having a top structure embodied to support one or more of said components, and/or said top drive device, and with a raised straddle frame, e.g. that has a height of at least 2 meters above the drill floor when the cart is positioned on the drill floor underneath the trolley. This for example allows to place the cart over the well center, and as is preferred, over a stick-up portion of a drilling string held by a slip device or the rotatable head clamp component.

The present invention also relates to a wellbore drilling installation and a method for drilling a wellbore or other wellbore related activities. The installation comprises a drilling tower, drill floor with well center, and a slip device system comprising a first slip device and a second slip device. A top drive trolley with top drive device is guided along a vertical trolley rail. The trolley comprises a frame and the top drive device is attached to the frame independent from first and second vertical frame members. The installation further comprises a rotatable head clamp component adapted to be releasably connected to and suspended from the first and second vertical frame members of the trolley. The rotatable head clamp component comprises a housing, an open-centered rotary body, a drilling operation thrust bearing arranged between the housing and the rotary body adapted to support the load of a drilling tubulars string during a drilling operation. The component further comprises a retainer assembly, e.g. a tool joint retainer assembly, that is embodied to axially retain the top end of the drilling tubular whilst the top end of the tubular remains accessible for the rotary stem of the top drive device. The installation is embodied such that, with both the first and second slip devices in their respective retracted position, the rotatable head clamp component is lowerable by means of the trolley into a position in between the first and second slip devices onto a support structure that is adapted to support the load of a drilling tubulars string retained by the rotatable head clamp component.

The invention also relates to a method for operating a wellbore drilling installation as described herein, wherein a tapered drill string is assembled comprising a first drill string section composed of first diameter tubulars and a second drill string section composed of second diameter tubulars, wherein the method comprises:

a) keeping a first drill string section composed of first diameter tubulars suspended in the firing line by means of the first slip device, b) suspending, above said first drill string section, a further first diameter tubular from a first diameter rotatable head clamp component that is adapted to axially retain the top end of the first diameter tubular and that is connected to the trolley, c) connecting said further first diameter tubular to said suspended first drill string section, d) releasing said first slip device from the first drill string section and moving said first slip device in the retracted position thereof, e) lowering the trolley and thereby the first drill string section suspended from the first diameter rotatable head clamp component, until the first diameter rotatable head clamp component is in a position in between the first and second slip devices and is resting on a support structure of the drill floor that is adapted to support the load of string retained by said first diameter rotatable head clamp component, e.g. onto said pair of rails supporting the first and second slip device, f) disconnecting the first diameter rotatable head clamp component from the trolley, e.g. from the first and second vertical frame members of the trolley, g) arranging a second diameter rotatable head clamp component in the firing line above the first diameter rotatable head clamp component and suspending said second diameter rotatable head clamp component from the trolley, e.g. connecting said second diameter rotatable head clamp component to the first and second vertical frame members of the trolley, h) securing said first diameter rotatable head clamp component to said trolley, e.g. via said second diameter rotatable head clamp component, i) lifting the trolley and thereby the second and first diameter rotatable head clamp components as well as the drilling tubulars string, j) moving the first slip device into the operational position thereof, engaging said first slip device with the drilling tubulars string, and transferring the load of the drilling tubulars string onto the first slip device, k) disengaging the first diameter rotatable head clamp component from the drilling tubulars string, releasing the first diameter rotatable head clamp component from the trolley, and moving said first diameter rotatable head clamp from the firing line, l) arranging a second diameter tubular in the firing line and suspending said second diameter tubular from the second diameter rotatable head clamp component, m) connecting said second diameter tubular to the drilling tubulars string suspended from the first slip device, n) transferring the load of the drilling tubulars string from the first slip device onto the second diameter rotatable head clamp component, releasing the first slip device from the drilling tubulars string, and moving said first slip device into the retracted position thereof, o) lowering the trolley and thereby the drilling tubulars string suspended from the second diameter rotatable head clamp component, p) moving the second slip device into the operational position thereof, engaging said second slip device with the second diameter tubular of the drilling tubulars string, and transferring the load of the drilling tubulars string onto the second slip device, q) disengaging the second diameter rotatable head clamp component from the drilling tubulars string, and lifting the trolley and the second diameter rotatable head clamp component, r) arranging a further second diameter tubular in the firing line and suspending said second diameter tubular from the second diameter rotatable head clamp component, s) connecting said further second diameter tubular to the drilling tubulars string suspended from the second slip device, t) releasing said second slip device from the drilling tubulars string, lowering the trolley and thereby the drilling tubulars string, re-engaging the second slip device with the drilling tubulars string and transferring the load of the drilling tubulars string onto the second slip device, and repeating steps r, s, t to complete a second section of the drilling tubulars string composed of second diameter tubulars.

It will be appreciated by the skilled person that, in practice, the above method steps are to be performed generally in chronological order. However, some steps can be done (at least in part) simultaneously, e.g. depending on the exact embodiment of the components of the installation, availability of crew to assist in the method steps, etc. At the same time one can envisage performing some additional method steps, e.g. of arranging a drill string sub that at one end has a first diameter connector portion and at the other end has a second diameter connector portion at the transition between the first and second diameter sections of the drill string to be assembled.

According to a second aspect thereof the present invention also relates to a wellbore drilling installation for drilling a wellbore or other wellbore related activities, said installation comprising:

a drilling tower, a drill floor having a well center through which a drilling tubulars string can pass along a firing line into the wellbore, a slip device system in or on said drill floor comprising a first slip device and, preferably, a second slip device, each adapted to clamp onto and support the load of a drilling tubulars string, each slip device being movable between an operational position aligned with the firing line and a respective retracted position remote from the firing line, each slip device having a lateral opening allowing to disengage the slip device in its operational position from a drilling tubulars string in the firing line and move the slip device into its respective retracted position and vice versa, at least one vertical trolley rail, a trolley guided along said at least one vertical trolley rail, a main hoisting device adapted to lift and lower said trolley along said at least one vertical trolley rail relative to the drilling tower, e.g. said main hoisting device comprising one or more winch driven cables from which said trolley is suspended, a top drive device attached to the trolley, said top drive device comprising one or more top drive motors and a rotary stem driven by said one or more top drive motors in order to impart rotary motion to a drilling tubulars string when connected to said top drive device, wherein the trolley comprises a frame with first and second vertical frame members each comprising a lower connector member, e.g. an eye, adapted to be connected to a component that is adapted to be suspended from the first and second vertical frame members, wherein, preferably, said top drive device is attached to the frame of the trolley independent from the first and second vertical frame members, wherein said installation further comprises at least a first rotatable head clamp component and a second rotatable head clamp component, each adapted to be releasably connected to and suspended from said first and second vertical frame members of the trolley, wherein each of said first and second rotatable head clamp components comprises:

a housing provided with one or more connector members that are adapted to be connected to the lower connector members of the first and second vertical frame members in order to suspend the rotatable head clamp component from the trolley, an open-centered rotary body with a vertical passage there through that at least allows to lower the head clamp component from above over a top end of a drilling tubular held in said firing line by one of said first and second slip devices, a drilling operation thrust bearing arranged between said housing and said rotary body and adapted to support the load of a drilling tubulars string suspended from the rotatable head clamp component during a drilling operation, a retainer assembly, e.g. a tool joint retainer assembly, that is embodied to axially retain the top end of the drilling tubular, e.g. a tool joint or box member at the top of said drilling tubular, whilst the top end of the tubular remains accessible for the rotary stem of the top drive device, and to support the load of a drilling tubulars string suspended in the firing line.

Herein, preferably, the first rotatable head clamp component is adapted to handle first diameter tubulars and the second rotatable head clamp component is adapted to handle first diameter tubulars, the second diameter being greater than the first diameter. It is also envisaged that the first and second rotatable head clamp components are adapted to handle the same diameter tubulars, yet with a different top end design, e.g. a different tool joint or the like.

In embodiment the installation comprises link members adapted to suspend one of the first and second rotatable head clamp components from the other of said first and second rotatable head clamp components, e.g. in a process wherein a tapered drill string is employed.

It will be appreciated that an installation according to the second aspect of the invention may comprise one or more of the technical features discussed in herein in the context of the first aspect of the invention.

The second aspect of the invention also relates to a method for operating a wellbore drilling installation of the second aspect of the invention. For example the method involves the step of suspending one of the first and second rotatable head clamp components from the other of said first and second rotatable head clamp components, e.g. in a process wherein a tapered drill string is employed.

The second aspect of the present invention also relates to a system comprising in combination a first rotatable head clamp component and a second rotatable head clamp component, each adapted to be releasably connected to and suspended from a trolley guided vertically relative to a drilling tower, wherein each of said first and second rotatable head clamp components comprises:

a housing provided with one or more connector members that are adapted to be connected to the lower connector members of the first and second vertical frame members in order to suspend the rotatable head clamp component from the trolley, an open-centered rotary body with a vertical passage there through that at least allows to lower the head clamp component from above over a top end of a drilling tubular held in said firing line by one of said first and second slip devices, a drilling operation thrust bearing arranged between said housing and said rotary body and adapted to support the load of a drilling tubulars string suspended from the rotatable head clamp component during a drilling operation, a retainer assembly, e.g. a tool joint retainer assembly, that is embodied to axially retain the top end of the drilling tubular, e.g. a tool joint or box member at the top of said drilling tubular, whilst the top end of the tubular remains accessible for the rotary stem of the top drive device, and to support the load of a drilling tubulars string suspended in the firing line.

Herein, preferably, the first rotatable head clamp component is adapted to handle first diameter tubulars and the second rotatable head clamp component is adapted to handle first diameter tubulars, the second diameter being greater than the first diameter. It is also envisaged that the first and second rotatable head clamp components are adapted to handle the same diameter tubulars, yet with a different top end design, e.g. a different tool joint or the like.

In embodiment the combination further comprises link members adapted to suspend one of the first and second rotatable head clamp components from the other of said first and second rotatable head clamp components, e.g. in a process wherein a tapered drill string is employed.

According to a third aspect thereof the invention relates to a method for operating a wellbore drilling installation, which comprises:

a drilling tower, a drill floor having a well center through which a drilling tubulars string can pass along a firing line into the wellbore, a slip device system in or on said drill floor comprising a first slip device and, preferably, a second slip device, each adapted to clamp onto and support the load of a drilling tubulars string, each slip device being movable between an operational position aligned with the firing line and a respective retracted position remote from the firing line, each slip device having a lateral opening allowing to disengage the slip device in its operational position from a drilling tubulars string in the firing line and move the slip device into its respective retracted position and vice versa, at least one vertical trolley rail, a trolley guided along said at least one vertical trolley rail, a main hoisting device adapted to lift and lower said trolley along said at least one vertical trolley rail relative to the drilling tower, e.g. said main hoisting device comprising one or more winch driven cables from which said trolley is suspended, a top drive device attached to the trolley, said top drive device comprising one or more top drive motors and a rotary stem driven by said one or more top drive motors in order to impart rotary motion to a drilling tubulars string when connected to said top drive device, wherein the trolley comprises a frame with first and second vertical frame members each comprising a lower connector member, e.g. an eye, adapted to be connected to a component that is adapted to be suspended from the first and second vertical frame members, wherein, preferably, said top drive device is attached to the frame of the trolley independent from the first and second vertical frame members, wherein said installation further comprises at least a first rotatable head clamp component and, preferably, a second rotatable head clamp component, each adapted to be releasably connected to and suspended from said first and second vertical frame members of the trolley, wherein each rotatable head clamp component comprises:

a housing provided with one or more connector members that are adapted to be connected to the lower connector members of the first and second vertical frame members in order to suspend the rotatable head clamp component from the trolley, an open-centered rotary body with a vertical passage there through that at least allows to lower the head clamp component from above over a top end of a drilling tubular held in said firing line by one of said first and second slip devices, a drilling operation thrust bearing arranged between said housing and said rotary body and adapted to support the load of a drilling tubulars string suspended from the rotatable head clamp component during a drilling operation, a retainer assembly, e.g. a tool joint retainer assembly, that is embodied to axially retain the top end of the drilling tubular, e.g. a tool joint or box member at the top of said drilling tubular, whilst the top end of the tubular remains accessible for the rotary stem of the top drive device, and to support the load of a drilling tubulars string suspended in the firing line, and wherein the method comprises a step of suspending a drill string section from the rotatable head clamp component and the step of lowering the trolley and thereby the drill string section suspended from the rotatable head clamp component, until the rotatable head clamp component is resting on a support structure that is adapted to support the load of string retained by said first diameter rotatable head clamp component, e.g. of the drill floor, e.g. in a position in between first and second slip devices, e.g. on a pair of rails supporting the one or more slip devices.

In an embodiment the method comprises the step of providing a drive motor distinct from the top drive device and connecting said drive motor to the top end of a drill string section that is suspended from the rotatable head clamp component that is resting on the support structure that is adapted to support the load of string retained by said first diameter rotatable head clamp component, e.g. of the drill floor, e.g. in a position in between first and second slip devices, e.g. on a pair of rails supporting the one or more slip devices. For example this step is performed during repair, removal, or exchange of the top drive device of the installation.

The present invention also relates to a method for operating of wellbore drilling installation, e.g. for drilling a wellbore, preferably an installation as described herein, wherein the method comprises the use of a first rotatable head clamp component adapted or set to handle first diameter drilling tubulars, and of a second rotatable head clamp component adapted or set to handle second diameter drilling tubulars, and wherein the method comprises the step of suspending, e.g. via additional link members one of said first and second rotatable head clamp components from the other of said first and second rotatable head clamp components, wherein, preferably, said other of said first and second rotatable head clamp components is suspended from a trolley that is vertically guided relative to a drilling tower. This method is e.g. envisaged when drilling a borehole using a tapered drilling tubulars string, wherein the drilling tubulars string is retained by the lower one of said two rotatable head clamp components.

The invention is envisaged primarily for offshore drilling, e.g. from a floating drilling vessel, but may also be used on land.

The invention will now be described with reference to the appended drawings.

DETAILED DESCRIPTION OF EMBODIMENTS

Figure 1:
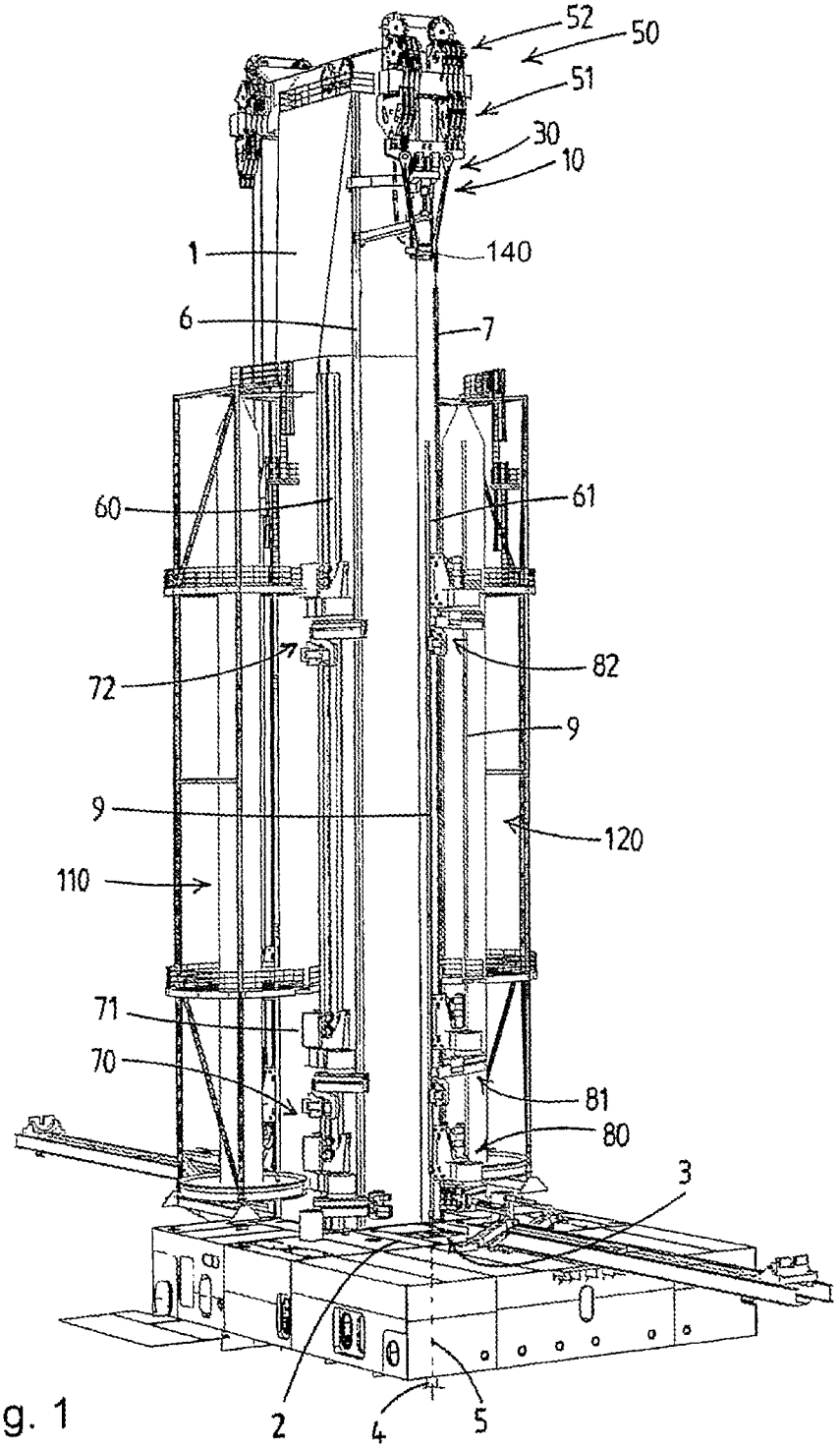
FIG. 1 shows a wellbore drilling installation according to the invention.

FIG. 1 shows a wellbore drilling installation with a trolley, top drive device, and rotatable head clamp component, a drill floor and a slip device system.

It is envisaged that the depicted installation is part of an offshore drilling vessel for performing offshore drilling and/or other wellbore related activities, e.g. well intervention. It will be appreciated that, when desired, the invention is also applicable to land based drilling installations.

The installation comprises a drilling tower 1 that is here embodied as a mast with a closed contoured steel structure with at least one firing line 5 outside of the mast itself. For example the mast is arranged adjacent a moonpool of a drilling vessel, or over a larger moonpool with two firing lines along opposed outer faces of the mast 1 as is known in the art.

In an alternative design the drilling tower is embodied as a derrick with the firing line within the structure of derrick, e.g. the derrick having a lattice structure placed over the moonpool.

FIG. 1 shows a drill floor 2 having a well center 3 provided with a slip device system with two slip devices 8*a,b* that can travel over associated track into and out of the firing line arranged at said location.

A drilling tubulars string 4 can pass along a firing line 5 through the well center 3.

The mast 1 is at the side of the drill floor 2 provided with two parallel vertical trolley rails 6, 7.

A trolley 10 is guided along the trolley rails 6, 7. A top drive device 30 is attached to the trolley 10.

The top drive device 30 comprises in this example four electric top drive motors 31, 32, 33, 34 which commonly drive, via gearbox or transmission housing 35, a rotary stem 36.

As known in the art the stem 36 is connectable, e.g. via a threaded connection, e.g. via a saver sub, to the top end of a drilling tubular aligned with the firing line. Thereby the top drive device 30 is able to impart rotary motion and drive torque to a drilling tubulars string 4.

A main hoisting device 50 is provided that is adapted to move the trolley with the top drive device up and down along the vertical trolley rails 6,7.

For example the frame of the trolley 10 and hoisting device 50 have sufficient strength and capacity to handle a firing line load of 1000 tons or more, e.g. over 1500 tons, in the firing line.

A left-hand motion arm rail 60 and a right-hand motion arm rail 61 are present on opposed lateral sides of a vertical path of travel of the trolley 10 with the top drive device 30 along said the vertical trolley rails 6,7.

On each of said motion arm rails 60, 61 at least one, here three as is preferred, motion arm assembly 70, 71, 72, 80, 81, 82 is arranged. Each assembly is, as preferred independently controlled from any other assembly on the same rail 60, 61, vertically mobile along the respective rail by a respective motion arm assembly vertical drive.

As depicted there are two tubulars storage racks 110, 120, each along a respective side of the mast 10. These racks 110, 120 are each adapted to store multi-joint tubulars, here triples 9 (about 36 meter), therein in vertical orientation.

It is illustrated that two of the motion arm assemblies 71, 72, 81, 82 on each vertical rail 60, 61 are equipped with a tubular gripper. The height of the rails 60, 62 is at least such that the upper assembly 72, 82 can be arranged to grip the tubular in the storage rack 110, 120 at an appropriately high location.

The motion arm assemblies with grippers can be operated in unison to act as part of the tubular racker device allowing to transfer drilling tubulars stands, e.g. drill pipe or casing pipe or other drilling tubulars between the firing line 5 and the respective storage rack 110, 120.

Figure 2:
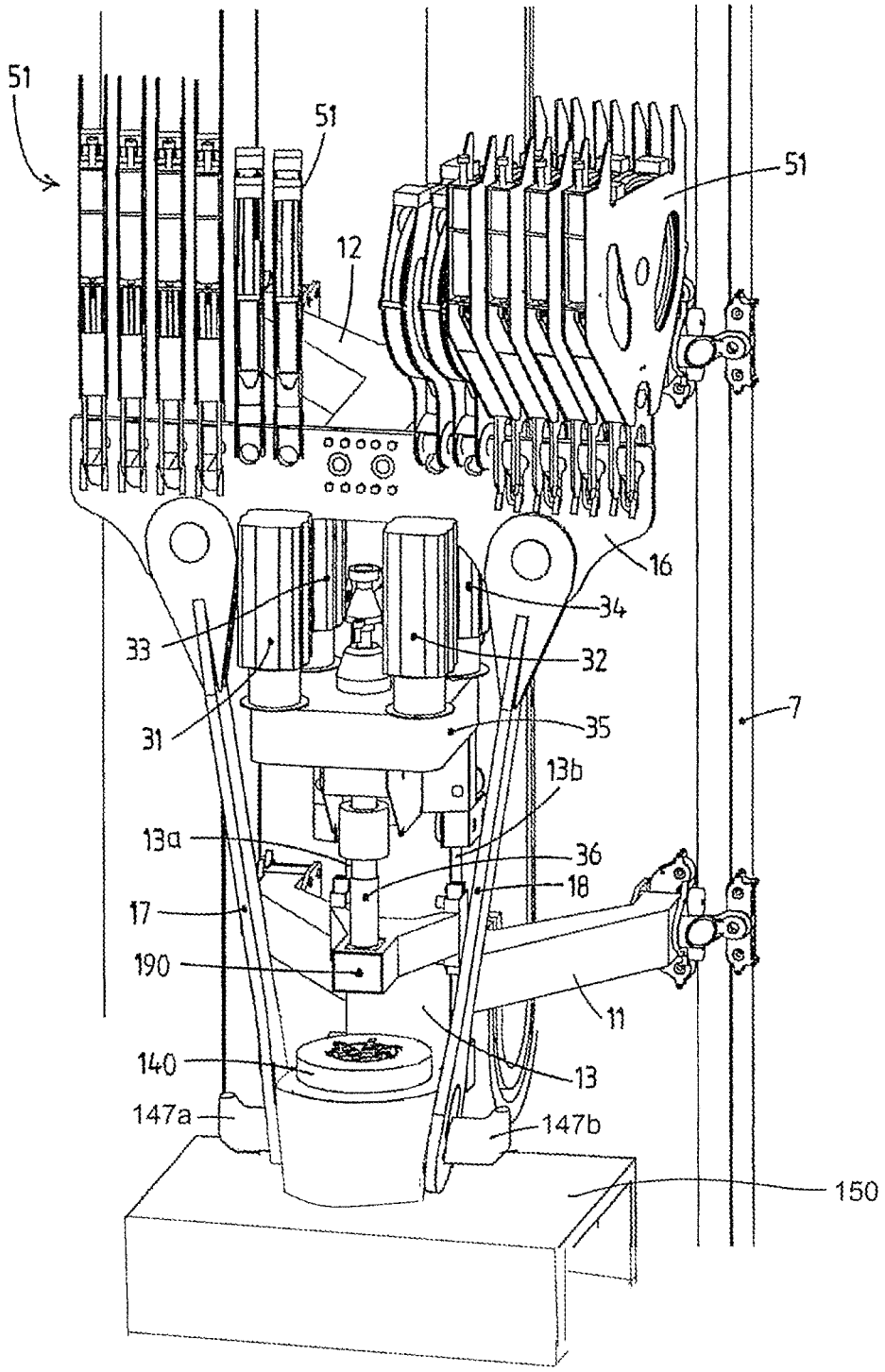
FIG. 2 shows in side view the trolley and top drive device of the installation of FIG. 1.
Figure 3:
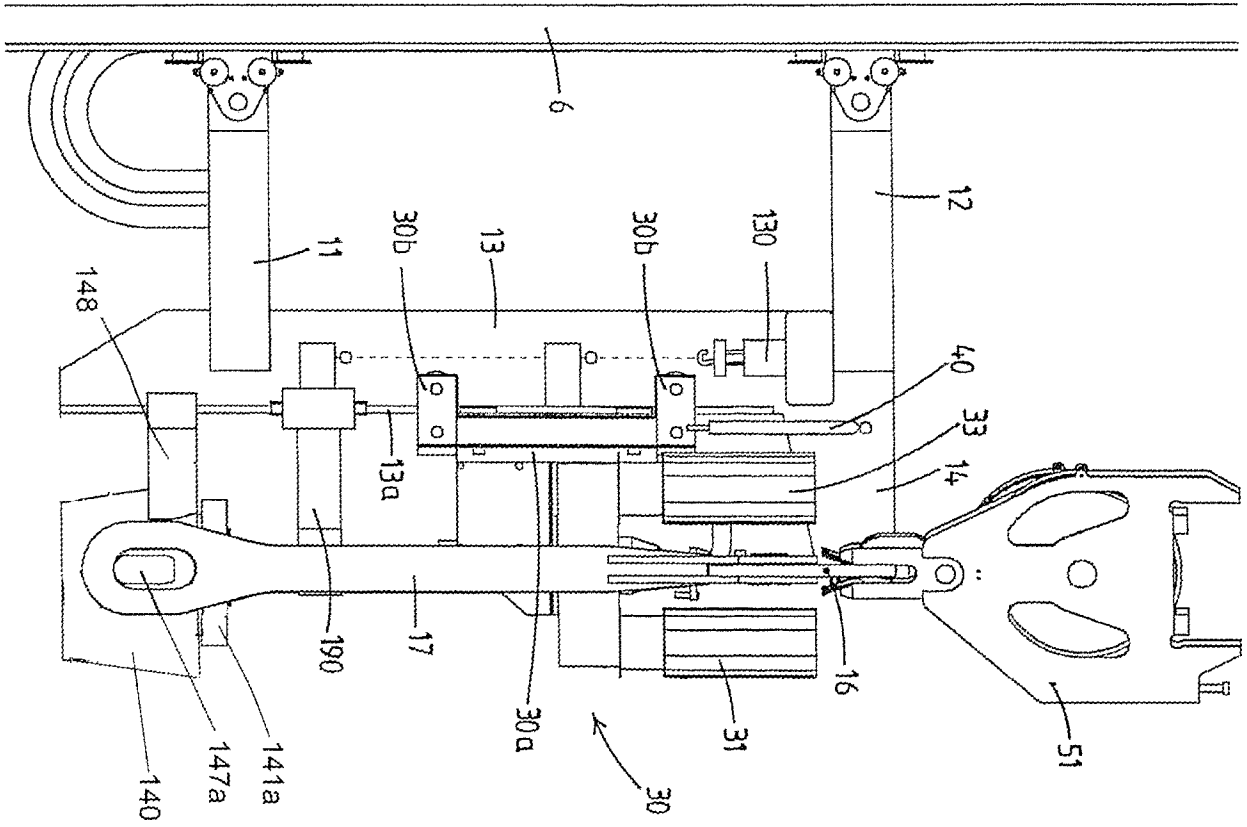
FIG. 3 shows from the rear the trolley and top drive device of the installation of FIG. 1.

As can be seen in FIGS. 1-3 the trolley 10 has a rigid frame structure with upper and lower trolley beams 11, 12 that each have at each end thereof rollers engaging the respective trolley rail 6, 7 on the mast 1. These beams 11, 12 here have about a V-shape in top view. These beams 11, 12 support here a single vertical rear frame member 13, that embodies sort of a spine of the trolley 10 and that spans the height between the beams 11, 12.

This rear frame member 13 is provided with one or more, here a pair of parallel, vertical guide rails 13*a, b*. The top drive device 30 is provided with a chassis 30*a* with rollers 30*b* or other guide members that cooperate with said guide rails 13*a, b*.

This rear frame member 13 may be embodied as a box girder.

From the top end of said rear frame member 13 a forward cantilevered frame member 14 extends, away from the mast 1. At its forward end this frame member 14 carries a transverse horizontal top frame member 16, generally in a transverse imaginary plane that encompasses the firing line 5.

The top frame member 16 is provided with connectors, here holes, for connecting thereto a series of cable sheaves 51 in a side by side arrangement. The mast 1, as a crown block, is also provided with cable sheaves 52 so that the trolley 10 is suspended by one or more winch driven cables in a multiple fall arrangement.

The trolley frame further comprises first and second frame or link members 17, 18 which are suspended from the transverse horizontal top frame member in a transverse plane that encompasses the firing line. As depicted these members 17, 18 are directly and pivotally connected to the frame member 16, here pivotal about an axis perpendicular to said transverse plane. As is preferred each member 17, 18 has an upper eye, as here through two spaced apart tabs, with a pin being secured through said eye and through a hole in the frame member 16.

A rotatable head clamp component 140 is releasably connected to the lower ends of the first and second members 17, 18.

As discussed the vertical guide rails 13*a,b* guide the top drive device 30 as the rollers 30*b* of the chassis 30*a* ride along said rails 13*a, b*.

In this embodiment, as preferred, the same guide rails 13*a,b* also guide the component 140, here a guidance portion 140*a* thereof.

Also, as preferred, the guide rails 13*a, b* guide the wrench and/or clamping device 190, which will be discussed later.

In addition to guiding said components, the one or more guide rails 13*a, b* here, as is preferred, also serve the purpose of absorbing any reaction torque that is caused by operation of the installation on the respective component and transmit said torque to the frame of the trolley 10.

Between the top drive device 30 and the trolley frame there are one or more vertical displacement actuators 40 so that the top drive device 30 is vertically mobile relative to the frame by said one or more vertical displacement actuators, here adapted to perform controlled lowering and raising of the top drive device during make up or breaking of the threaded connection between the quill or rotary stem on the one hand and the tool joint or box member of the tubular suspended from the rotatable head clamp component on the other hand.

The trolley is provided with an auxiliary hoisting device 130 that is adapted to vertically move at least the top drive device 30, here also the device 190, relative to the frame. It is depicted that the device 130 includes a chain hoist device, with a hook that can be coupled to either the top drive chassis 30*a* or the device 190 as shown in FIG. 3.

Reference numeral 190 indicates a wrench and/or clamp device that allows to retain the tool joint or box member held by the assembly 160 when make-up or break-up of a threaded connection is performed.

An embodiment of the rotatable head clamp component 140 is depicted in FIGS. 4, 5*a-c*. For example the rotatable head clamp component 140 is designed to handle a firing line load of at least 1000 tons, e.g. of 1500 tons or more.

With reference to FIGS. 4, 5*a-c*, an embodiment of the rotatable head clamp 140 will be discussed.

The head clamp 140 here comprises:

- a rotary open-centered body 141 defining a vertical passage 141*a* in line with firing line 5 to allow passage of a tubular of the drill string, e.g. a special sub fitted to the top end of the drill string tubular;
- a fire line load absorbing thrust bearing 143 supporting the rotary body 141, allowing rotation thereof under the full load of the drilling tubulars string hanging in the firing line, e.g. into the wellbore; for example the thrust bearing is adapted to support a vertical load of at least 1000 tons, e.g. of 1500 tons or more whilst the tubular string is rotated by the top drive,
- multiple mobile retainers 142 supported by the rotary body 141 so as to provide an operative and a non-operative mode of the rotatable head clamp.

In the shown embodiment, the rotatable head clamp comprises a housing 149 supporting the thrust bearing 143 and the load of the suspended drilling tubulars string.

Here, the rotary body is embodied as a cylinder 141*b* with a flanged top end 141*a* that supports the mobile retainers 142. The thrust bearing 143 supports the flanged top end 141*a* of the rotary body.

Furthermore, in the shown embodiment, one or more additional radial load bearings 144 are provided, e.g. around the cylinder 141*b* of the rotary body, e.g. as here at the bottom end of the rotary body 141. Optionally a frame part 149*a* is arranged between the thrust bearing 143 and the bearing 144 at the bottom end thereof.

In the shown embodiment, the housing 149 furthermore supports a centralizer 152 below the head clamp 140 to centralize the drill string. Such centralizers are known in the art.

Retainers 142 are movable between a non-operative position and an operative position. In the non-operative position (not shown) the retainers 142 allow for passage of a tubular of the drill string, e.g. of a special sub fitted to the drill string or drill string tubular, through the passage 141*a*. In the operative position as shown in FIG. 4, the retainers 142 engage below a shoulder 15*c* of the tool joint or box portion 15*b* of drilling tubular, e.g. of special sub, extending through the passage 141*a* so as to suspend said drill string or drilling tubular therefrom.

In the shown embodiment, the mobile retainers 142 each have a jaw 142*a* adapted to engage on a tubular, e.g. below a shoulder 15*c* thereof, which is preferably an exchangeable jaw, e.g. to be able to match the diameter and/or shape to the type of drilling tubular.

Figure 5C:
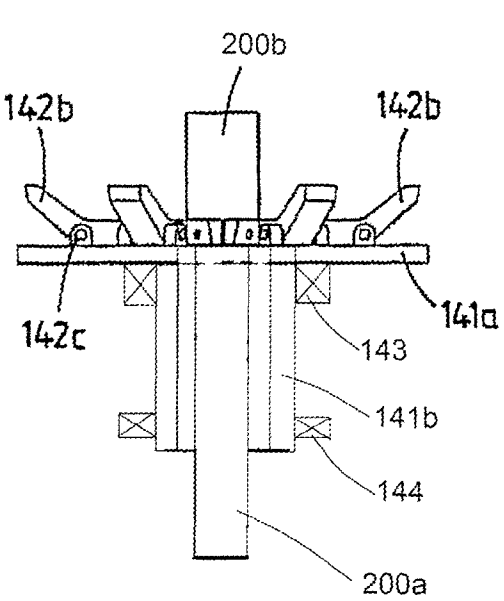
Figure 5B:
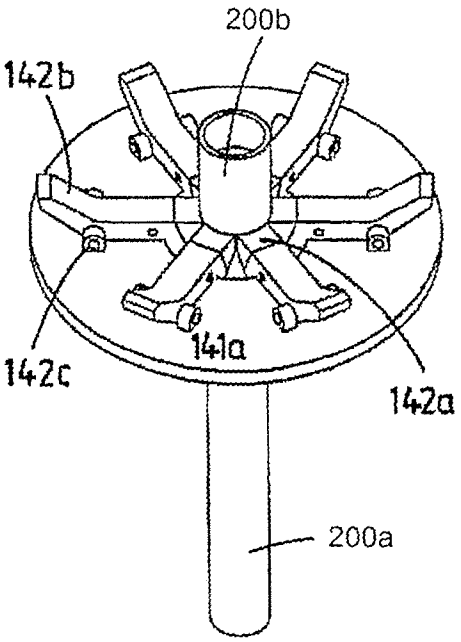
Figure 5A:
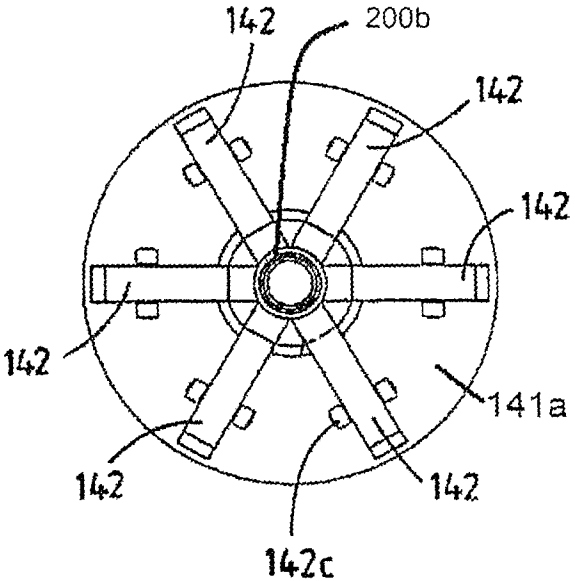

In FIGS. 5*a-c* a possible embodiment of a head clamp is shown in top view, a perspective top view and a side view. This head clamp is provided with mobile retainers 142 and 142' respectively.

Figure 4:
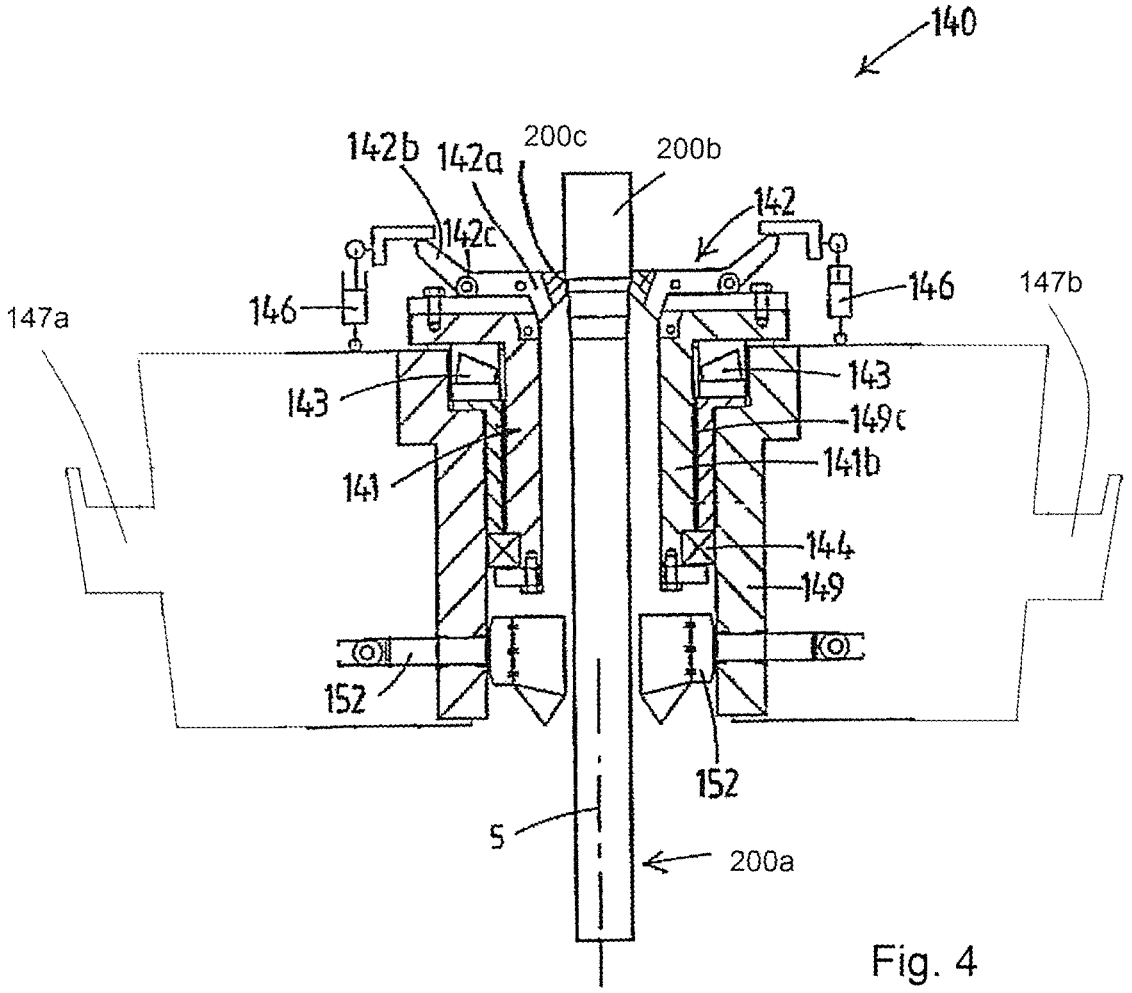
FIG. 4 illustrates an example of the rotatable head clamp component of the installation of FIG. 1, FIGS. 5*a-c* further illustrate the rotatable head clamp component of FIG. 4.
Figure 6B:
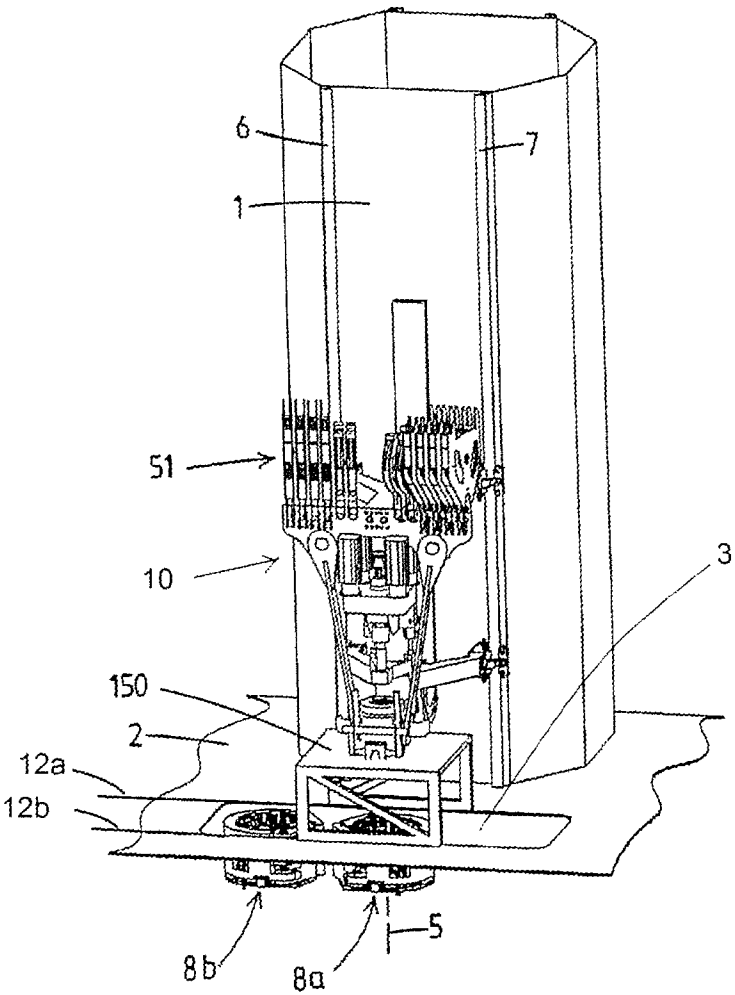
FIG. 6*a* illustrates a portion of the installation of FIG. 1 in side view, FIG. 6*b* the portion of FIG. 6*a* in perspective view.

The mobile retainers 142, 142' of FIG. 4 and FIG. 5 are embodied as a lever comprising an arm and a fulcrum, which fulcrum 142*c* is fixed to the rotary body, here flange 141*a*. One end 142*a* of the arm is adapted to—in the operative position—engage on the drilling tubular. Here, this end 142*a* of the arm is provided with clamping jaws 142*d*. In the non-operative position has cleared the area in line with the passage to allow the passage of a pipe of the drill string. The other end 142*b* of the arm is operable by an actuator 146 to move the opposite end of the arm between the operative and the non-operative position. Here, the actuator 146 is embodied as a hydraulically operable finger engaging on the arm end 142*b*. In FIG. 6 a part of the installation of FIG. 1 is depicted.

The drill floor is denoted with 2. In a recessed well center space 3 in the drill floor 2 provision is made for the slip device system with the two slip devices 8*a, b* that can be selectively aligned with the firing line.

Along opposed sides of the recessed well center space 3 in the drill floor 2 there is a pair of floor rails 2*a*, 2*b* on the drill floor over which a cart 150 can be moved into position over the well center 3.

As can be seen the cart 150, and possibly also other carts that are to be positioned over the well center in this invention, preferably has a straddling structure with a top structure 151 embodied to support one or more of the mentioned components, here the rotatable head clamp component 140, and with a raised straddle frame, e.g. that has a height of at least 2 meters above the drill floor 2. This e.g. allows for the cart 150 to be arranged in line with the firing line 5 and over a so-called stick-up end portion of a drill string that extends above the drill floor, e.g. over a height of at least 1 meter. The cart 150 is high enough to be arranged in the well center, over such a stick-up portion.

Figure 6A:
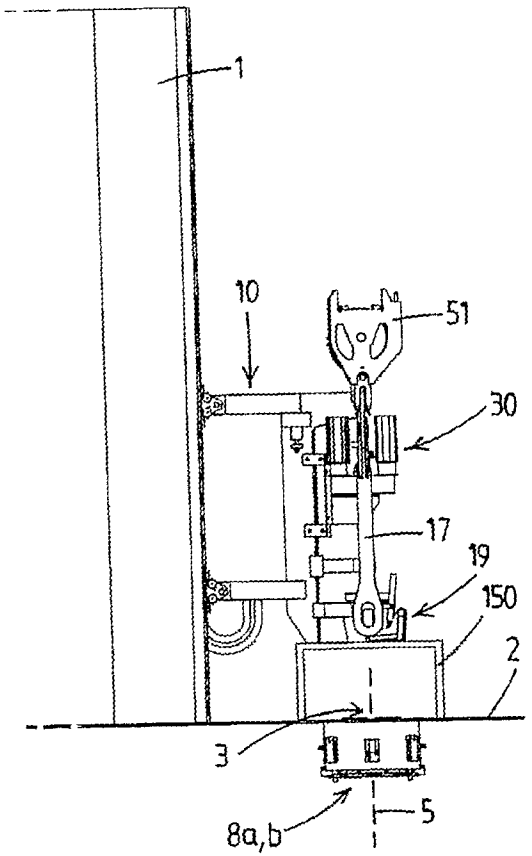

FIGS. 6*a, b* depict that the trolley 10 has been lowered so that the head clamp component 140 is brought to rest on the cart 150, e.g. to allow for removal of the component 140 and for attaching component to the first and second frame or link members 17, 18.

The slip device system 8 with first and second slip devices 8*a*, 8*b* is provided in front of the tower.

The slip devices 8*a*, 8*b* are both supported by a structure including the common pair of parallel support rails 111 that are mounted lower than the actual drill floor surface of which portions 2*b, c* are shown. On these rails 111 each slip device 8*a*, 8*b* can be moved between an active support or so-called central support position on the support structure, which position is aligned with the firing line 5, so that said line 5 passes through a vertical passage of the slip device 8*a*, 8*b*, and a retracted or so-called secondary position remote from the firing line 5. These retracted or secondary positions are on opposite sides of the firing line. It will be appreciated that in the support structure for these slip devices 8*a, b* is embodied to absorb the load of the drilling tubulars string, e.g. a vertical load of 1000 tons or more.

As preferred the rails 111 are arranged so that a so-called diverter housing 130 is below the slip device system. The housing 130 is aligned, as is usual, with the firing line 5. The diverter housing 130 will in practice for instance be connected to one or more mud circulation lines that lead to a mud treatment facility.

Figure 7:
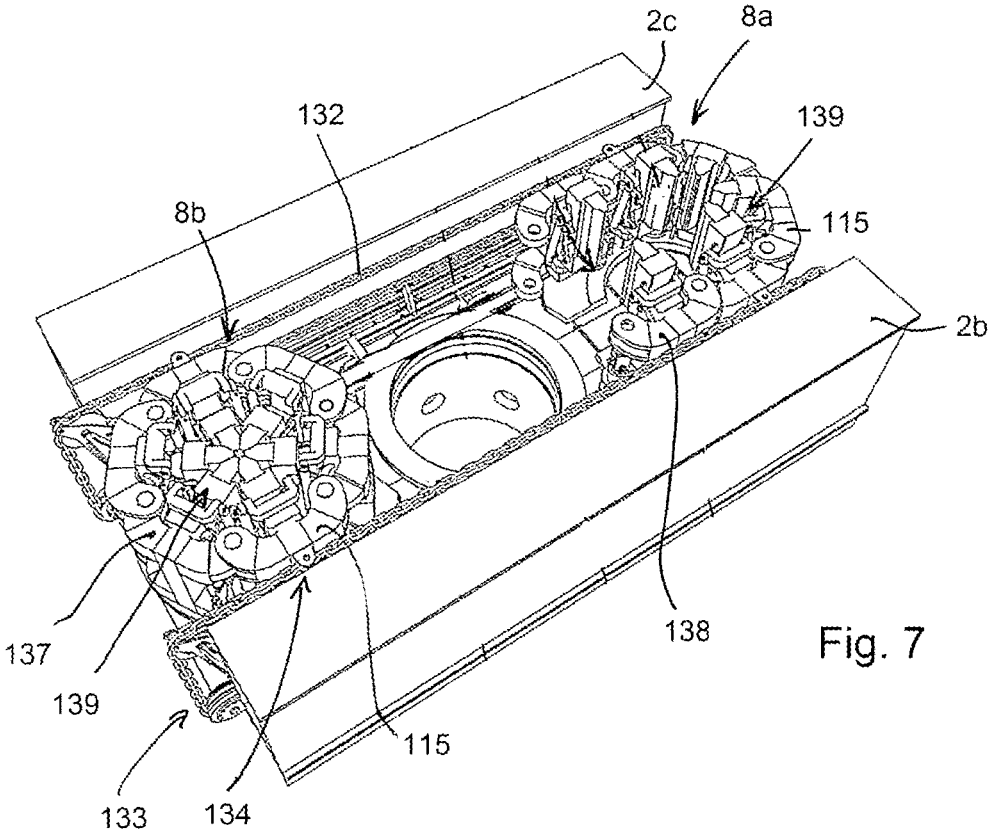
FIG. 7 illustrates in a perspective view the slip device system of the installation of FIG. 1.
Figure 8:
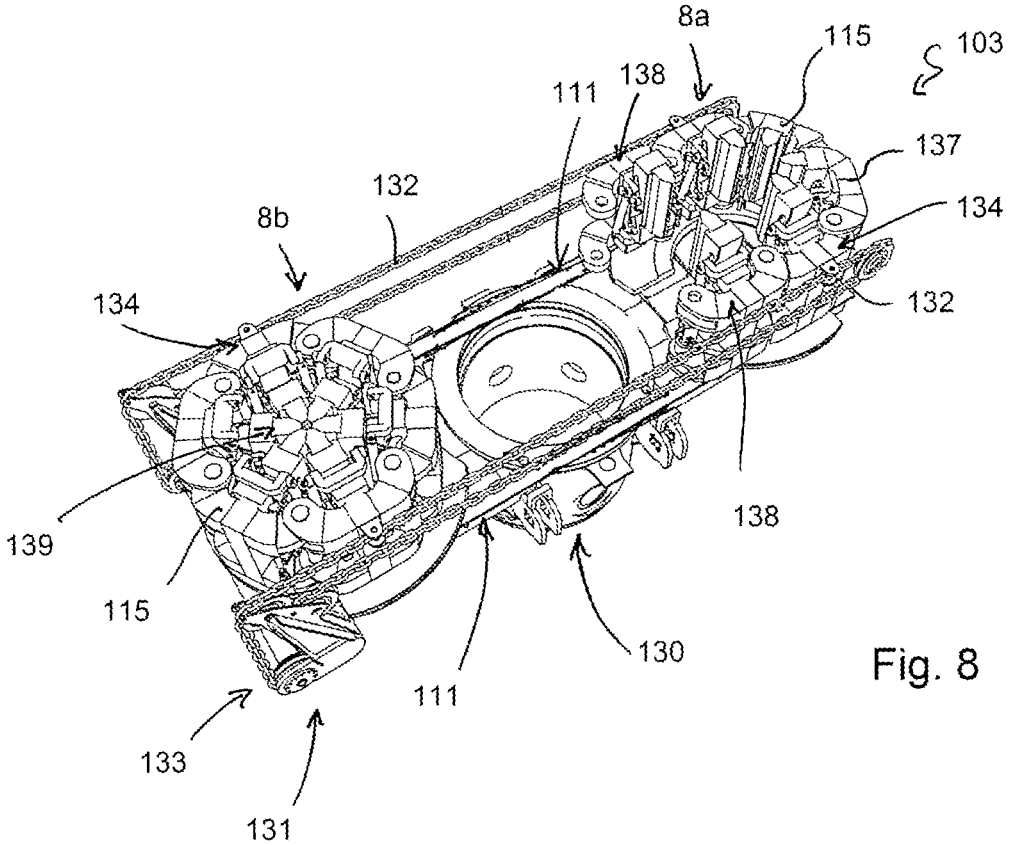
FIG. 8 shows part of the tubular support structure of FIG. 7.

In FIGS. 7, 8 an example of a transport system 131 for the slip devices 8*a, b* is visible.

In the particular embodiment transport system 131 comprises a looped chain 132 on each side of the track formed by the support rails 111. The chains are looped over sprocket wheels on opposite ends. One or more of these sprockets is driven by a drive motor 133 for pulling the chain. Each slip device 8*a, b* is provided with a coupling device for coupling the slip device with the chain. In the embodiment shown, the slip devices 8*a, b* are provided with arms 134 extending adjacent the chains, and provided with openings for receiving a pin or other coupling devices to attach the arms, and thus the devices 8*a, b*, to the chains. Once the slip device has been secured to the chains, it can be moved along the rails 111 by pulling the chains using the drive 133. In an alternative version, a transport system with one or more hydraulic cylinders for displacing the slip devices 8*a, b* is provided.

As shown in FIGS. 7 and 8 the body 115 of each slip device 8*a, b* comprises a frame composed out of multiple frame sections 137 including one or more, here two, mobile frame sections 138 that function as a door for selectively opening and closing a lateral opening of the slip device body.

In FIGS. 7 and 8 the slip device 8*b* has this lateral door opened, whereas the lateral door of the body of the slip device 8*a* is closed. As preferred, with the door closed and secured, the frame of the slip device is essentially ring shaped, which is beneficial for supporting the weight of a drilling tubular string retained by the slip device.

It is depicted that slip devices 8*a, b* are provided with multiple hydraulically actuable clamping members 139 that can be moved for engaging and releasing respectively a tubular in the vertical passage. In FIGS. 7, 8 the support devices 139 of the slip device 8*b* are in their inactive, retracted position and those of slip device 8*a* in their active clamping position.

The depicted wellbore drilling installation is embodied such that, with both the first and second slip devices 8*a*, 8*b* in their respective retracted position, the rotatable head clamp component 140 is lowerable by means of the trolley 10 into a position in-between the first and second slip devices 8*a, b* onto the support structure of the drill floor 2 which is adapted to support the load of a drilling tubulars string retained by the rotatable head clamp component 140. Here the component 140 can be lowered onto the pair of rails 111 supporting the first and second slip devices 8*a, b*. So instead of one of the slip devices 8*a, b* being arranged in line with the firing line 5, these slip devices 8*a, b* are moved into their respective retracted position and the component 140, in practical use methods retaining a drilling tubular or even a complete drilling tubulars string, and possibly even with the string being rotated by the top drive during said lowering, is lowered onto the support structure of the drill floor 2.

It will be appreciated that, in case of a non-recessed arrangement of the slip device system, so with one or more slip devices on the drill floor instead of in a recessed well center space 3, the invention entails that the rotatable head clamp component 140 is lowered onto the drill floor itself.

The design of the inventive drilling installation allows for various practical uses, e.g. in view of saving time during drilling operations. One such practical use will now be described in more detail with reference to the sequence of method steps illustrated in FIGS. 9-26. In these figures elements discussed above are denoted with the same reference numeral.

The described practical method relates to the desire to perform drilling operations with a so-called tapered drill string, wherein the diameter of drilling tubulars varies over the length of the drill string, most practically with the smallest diameter at the lower end and the diameter stepwise increasing towards the top end of the drill string. In particular a consideration is that conventional drilling installations are rather ineffective when in operations involving tapered drill strings, e.g. require lots of time and crew to perform changes when switching from one diameter of drilling tubular to another diameter of drilling tubular.

In the exemplary method described below it is assumed that a first diameter section 200 of a drilling tubular string is about to be completed, and the switch to the second diameter second 201 has to be made.

Figure 9:
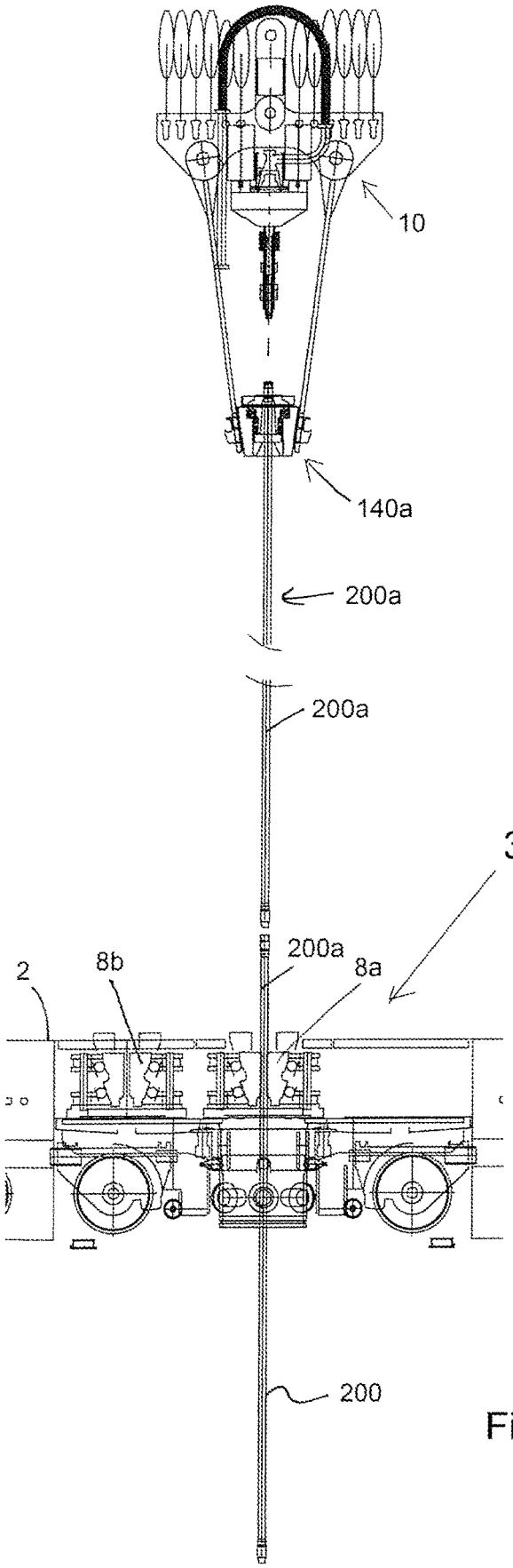
FIG. 9 illustrates keeping a first drill string section composed of first diameter tubulars suspended in the firing line by means of the first slip device, and suspending, above said first drill string section, a further first diameter tubular from a first diameter rotatable head clamp component that is adapted to axially retain the top end of the first diameter tubular and that is connected to the trolley.

FIG. 9 illustrates keeping a first diameter drill string section 200 composed of first diameter tubulars 200*a* suspended in the firing line 5 by means of the first slip device 8*a* in its active operative position, and suspending, above the first drill string section 200, a further first diameter tubular 200*a* from a first diameter rotatable head clamp component 140*a* that is adapted to axially retain the top end of the first diameter tubular 200*a* and that is connected to the trolley 10. For example the tubular 200*a* is a multi-joint tubular 200*a* that has been moved out of one of the storage devices 110, 120 by a pipe racker device into the firing line 5. The multi-joint tubular 200*a* can for instance be a triple, quad, or even a hex joint, e.g. having a length of about 180 ft. (6 times 30 ft.)

In normal drilling practice the new tubular 200*a* is made-up, connected to the suspended section 200. This can e.g. involve the use of a non-depicted iron-roughneck device that is operative at the well center.

Figure 10:
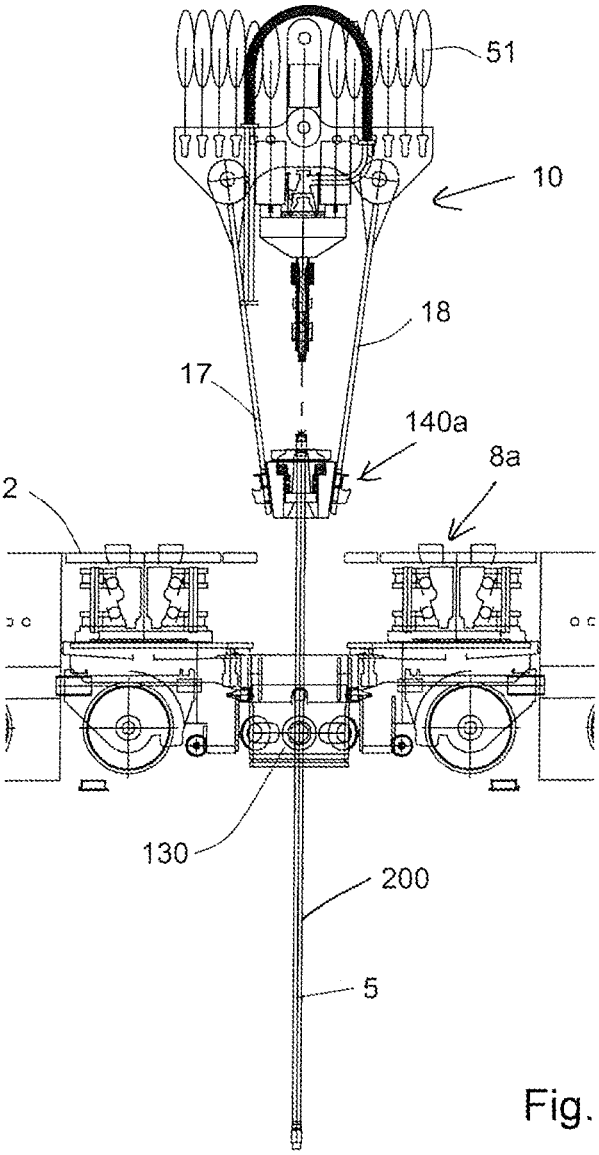
FIG. 10 illustrates, after having connected said further first diameter tubular to said suspended first drill string section, the release of said first slip device from the first drill string section and moving said first slip device in the retracted position thereof, as well as the lowering of the trolley and thereby the first drill string section suspended from the first diameter rotatable head clamp component

Once the new tubular 200*a* is connected, the drill string load can be transferred onto the trolley 10, via the component 140*a*, and the slip device 8*a* can be released from the first drill string section 200*a*. FIG. 10 illustrates that the released slip device 8*a*, after having also opened the lateral door thereof as discussed above, is moved laterally over the rails 111 into the retracted position thereof. Also illustrated is the lowering of the trolley 10 and thereby the first drill string section 200 suspended from the first diameter rotatable head clamp component 140*a*.

This lowering of the trolley 10 and the component 140*a* suspended therefrom and carrying the entire drill string section 200 is continued until the component 140*a* has reached a position in between the first and second slip devices 8*a, b*, resting on the support structure of the drill floor that is adapted to support the load of string retained by said first diameter rotatable head clamp component, here onto the pair of rails 111 supporting the first and second slip device. In this example, as can be seen in FIGS. 11 and 12, it is illustrated that an intermediate support member 118 having a central hole therein is placed on top of the rails 111 and that the component 140*a* is lowered onto said intermediate support member 118.

Figure 11:
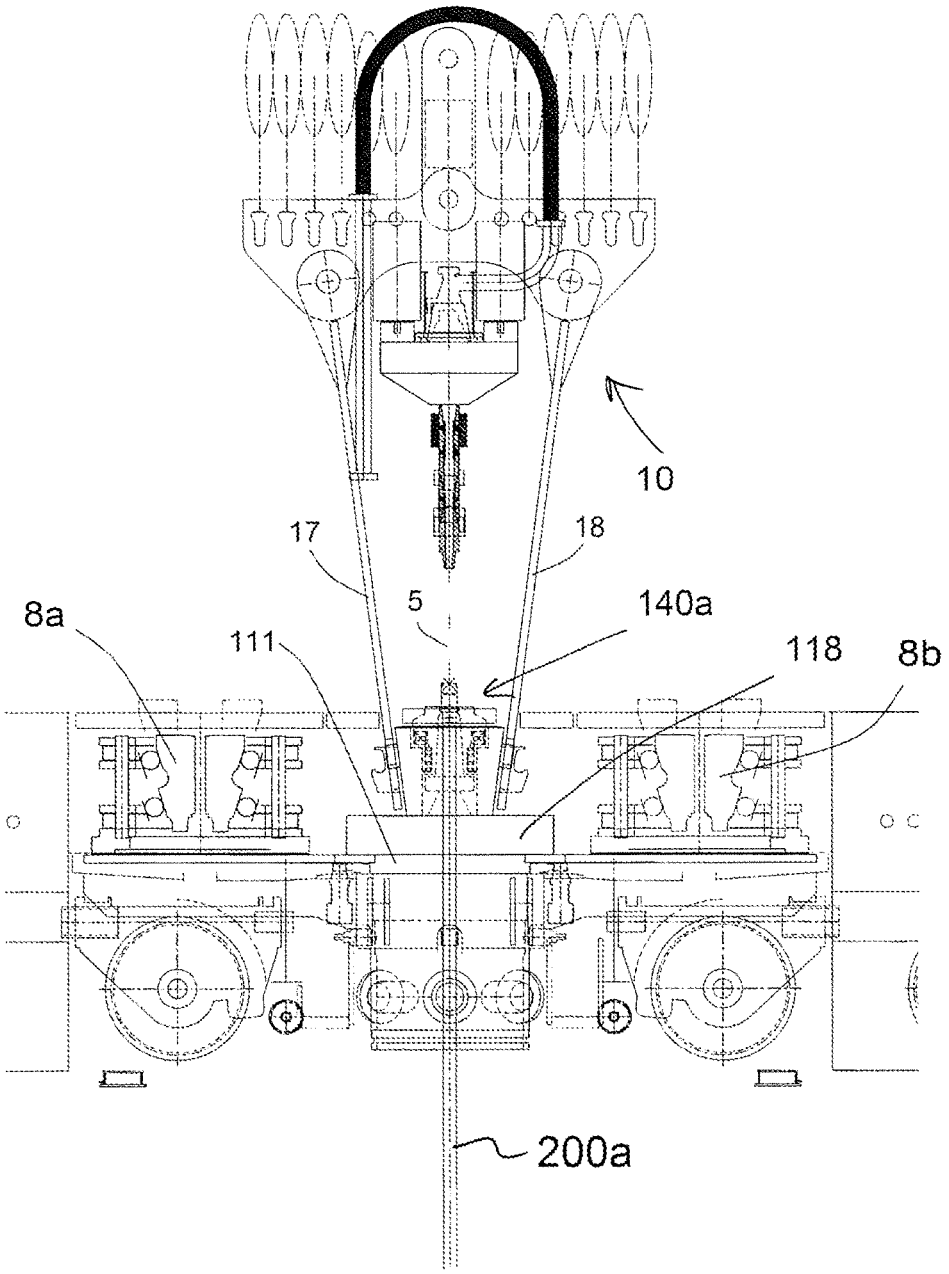
FIGS. 11 and 12 illustrate the completion of said lowering until the first diameter rotatable head clamp component has reached a position in between the first and second slip devices and resting on a support structure of the drill floor that is adapted to support the load of string retained by said first diameter rotatable head clamp component, here onto a pair of rails supporting the first and second slip device.
Figure 12:
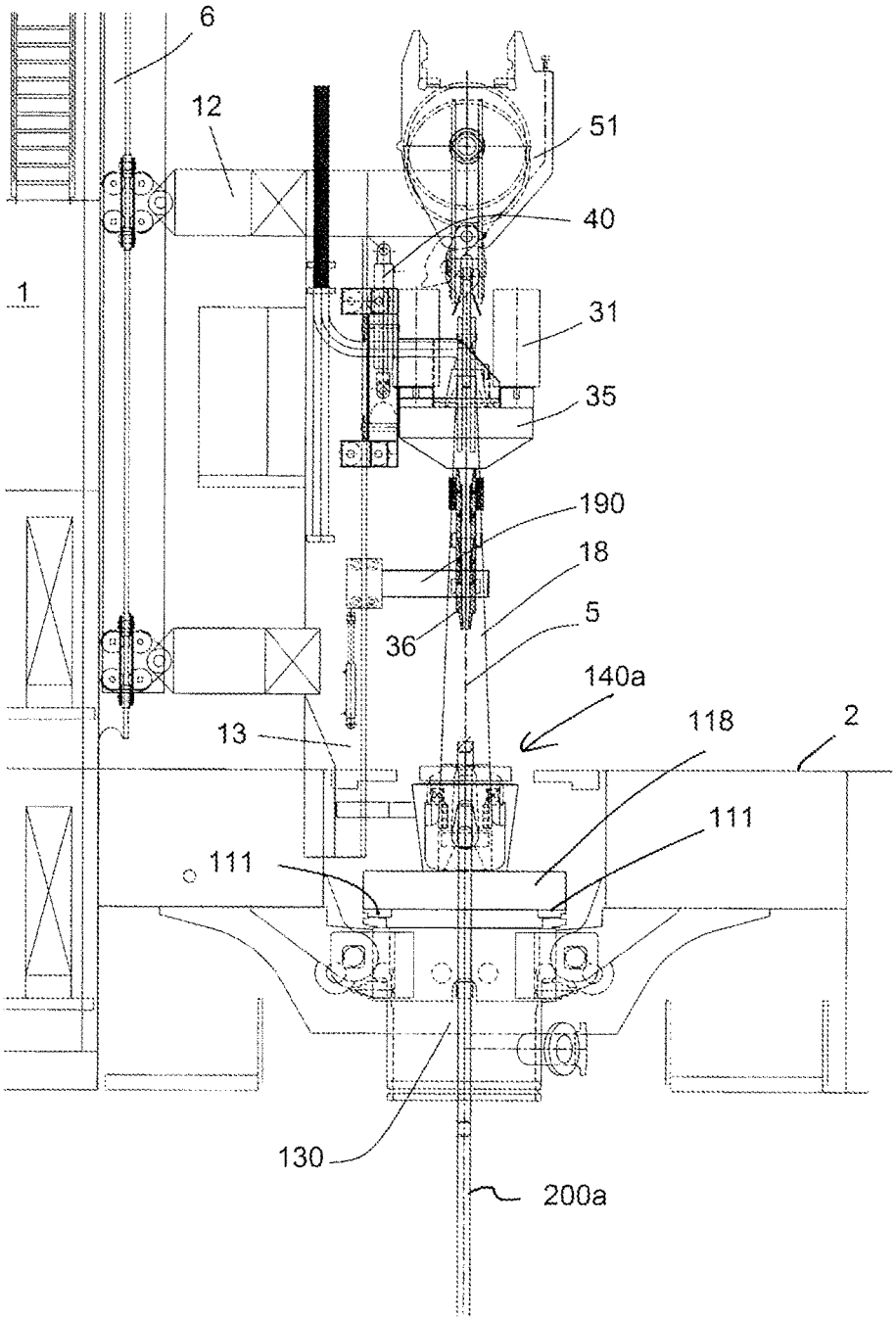

So, FIGS. 11 and 12 illustrate the completion of this lowering until the first diameter rotatable head clamp component 140*a* is resting on the support structure in between the first and second slip devices 8*a, b*.

Figure 13:
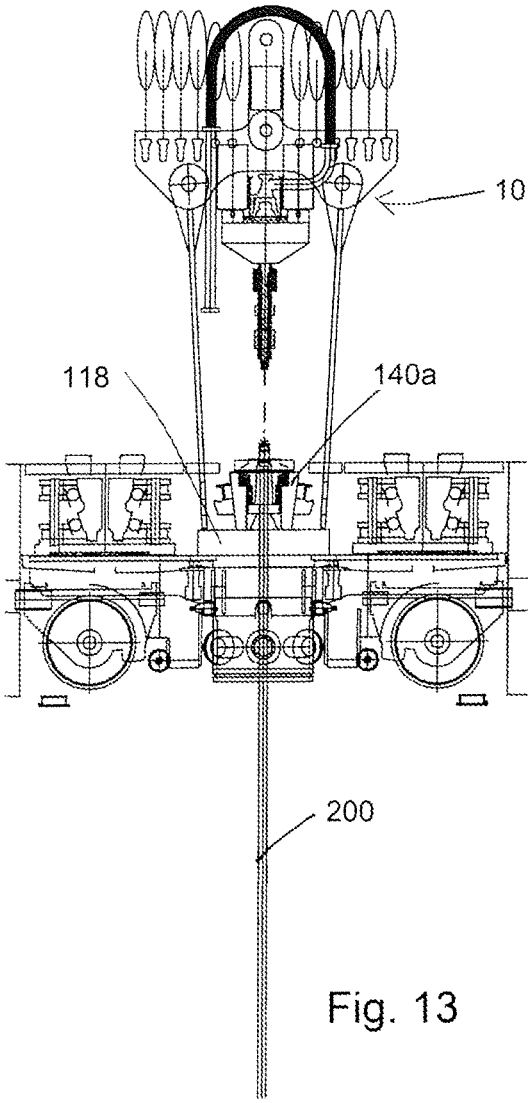
FIG. 13 illustrates disconnecting the first diameter rotatable head clamp component from the trolley, here from the first and second vertical frame members of the trolley.

The FIG. 13 then illustrates the disconnection of the first diameter rotatable head clamp component 140*a* from the trolley 10, here from the first and second vertical frame members 17, 18 of the trolley. This can be simple done in this embodiment by pivoting these members 17, 18 outwards so as to unhook the eyes of said members from the hook portions of the housing of the component 140*a*.

Figure 14:
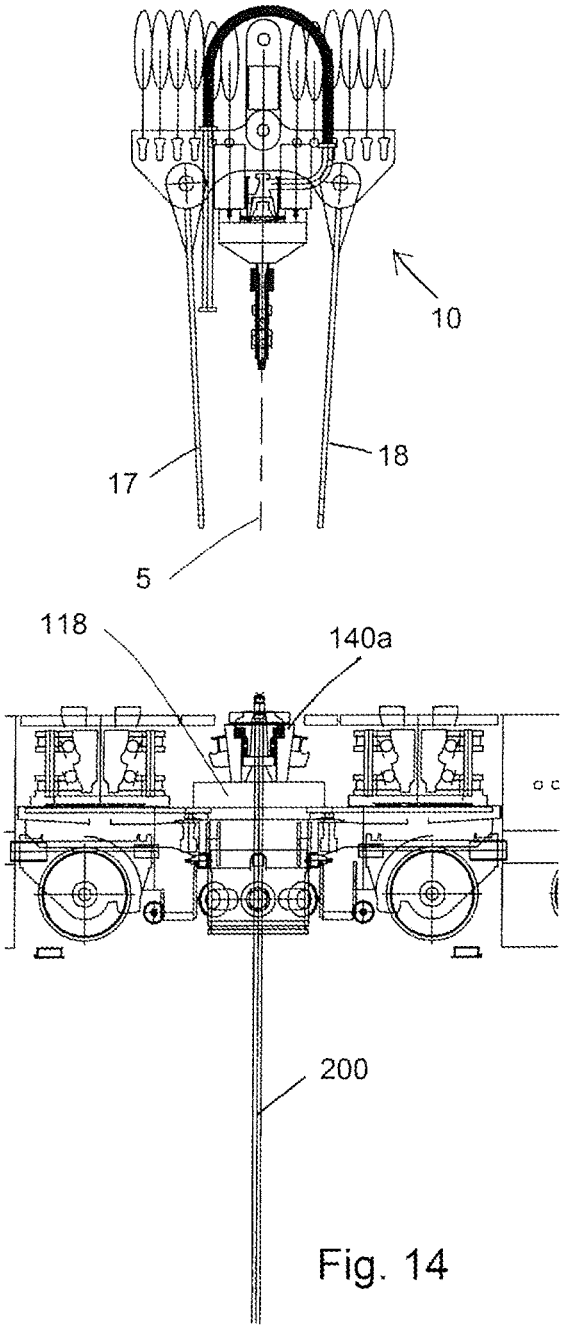
FIG. 14 illustrates lifting the disconnected trolley.

The FIG. 14 illustrates that the disconnected trolley 10, now without the component 140*a*, is lifted somewhat.

It will be appreciated that the entire drill string section 200 (and any sections below thereof) is now held by the component 140. As the component 140 includes the firing line load capacity thrust bearing one would now be able to rotate the drill string, e.g. by some drive other than the top drive carried by the trolley, e.g. some drive that is temporarily placed on the drill floor 2. The latter can for example be of use in case of a top drive failure, which requires repair and/or replacement of the top drive, when a lengthy period of the drill string being at standstill is not desired. A temporary drive, to be connected to the top end of the drill string now held by the component 140 lowered onto the support structure, may resolve this issue.

Figure 15:
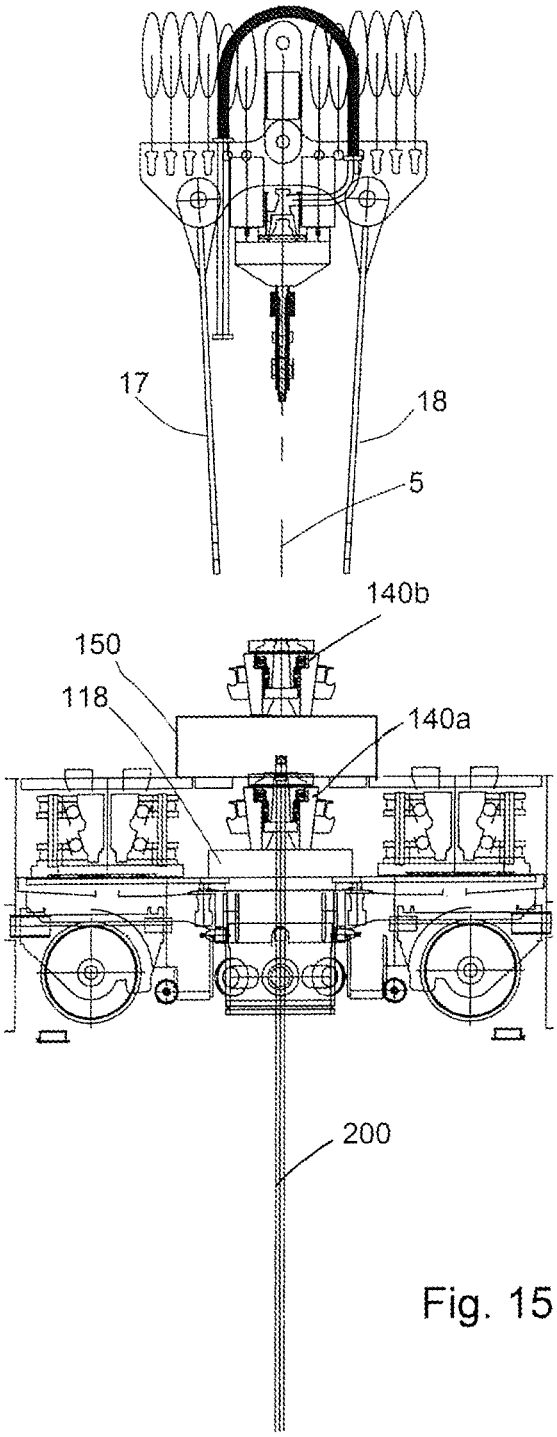
FIGS. 15 and 16 illustrate arranging a second diameter rotatable head clamp component in the firing line above the first diameter rotatable head clamp component and suspending said second diameter rotatable head clamp component from the trolley, here connecting said second diameter rotatable head clamp component to the first and second vertical frame members of the trolley.

FIG. 15 depicts that a second diameter rotatable head clamp component 140*b*, so having the same basic structure as the component 140*a* yet adapted to a second diameter that differs from the first diameter, is arranged in the firing line above the first diameter rotatable head clamp component 140*a*.

Figure 16:
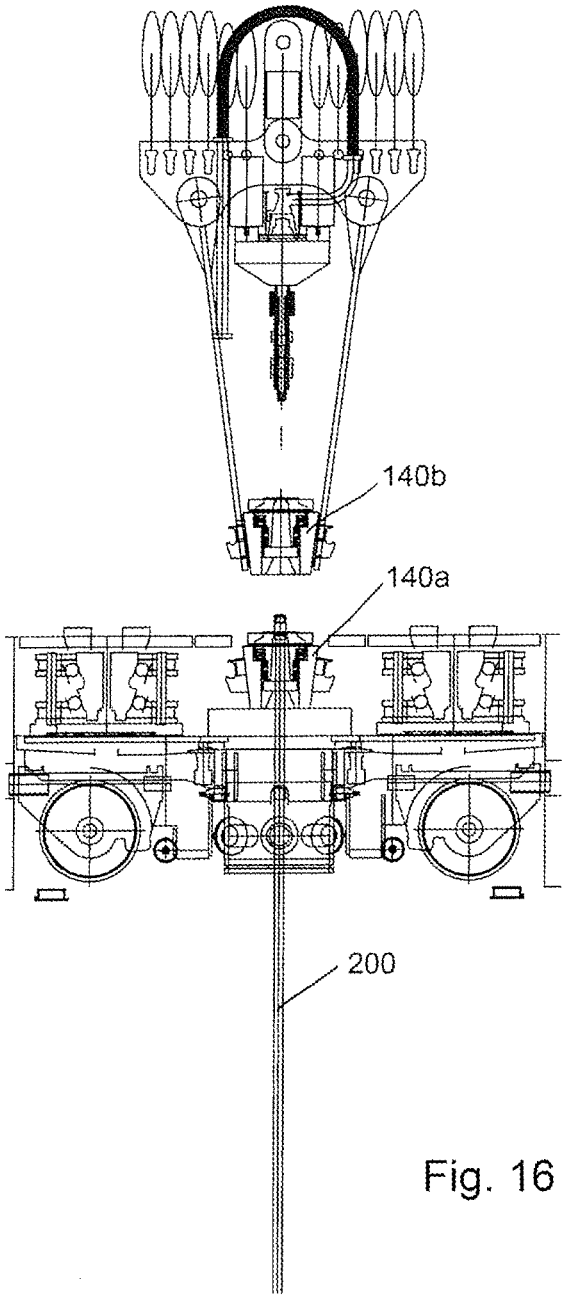

As will be appreciated a cart 150 may be employed to transport the component 140*b* into a position over the well center and the component 140*a* parked at the well center. The component 140*b* is then connected to the members 17, 18 of the trolley 10 and the cart 150 is moved away so that the second diameter rotatable head clamp component 140*b* is now suspended from the trolley 10 as illustrated in FIG. 16.

Figure 17:
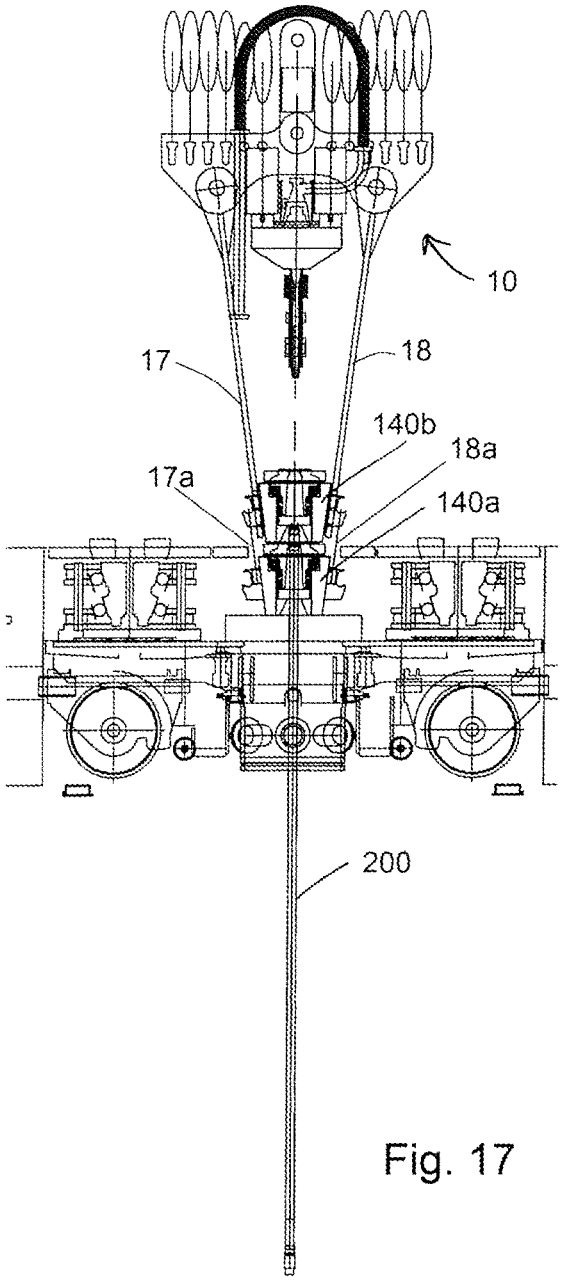
FIG. 17 illustrates securing said first diameter rotatable head clamp component to said second diameter rotatable head clamp component.

The FIG. 17 illustrates the step of securing the first diameter rotatable head clamp component 140*a*, still holding the first diameter drill string section 200, to the second diameter rotatable head clamp component 140*b*, e.g. with additional high load link members 17*a*, 18*a* forming a connection between hook portions of the respective housings of the components 140*a, b*. As will be appreciated these additional link members 17*a*, 18*a* will have to be able to support the load of the entire drill string, so at least the same capacity as of the component 140*a*.

Figure 18:
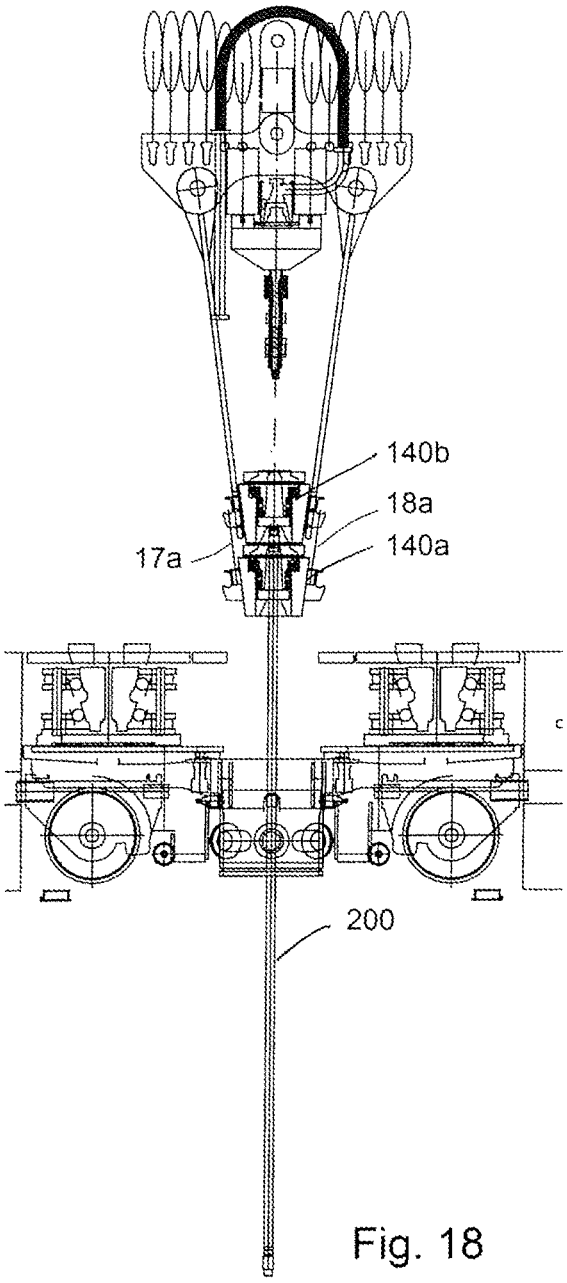
FIG. 18 illustrates lifting the trolley and thereby the second and first diameter rotatable head clamp components as well as the drilling tubulars string.
Figure 19:
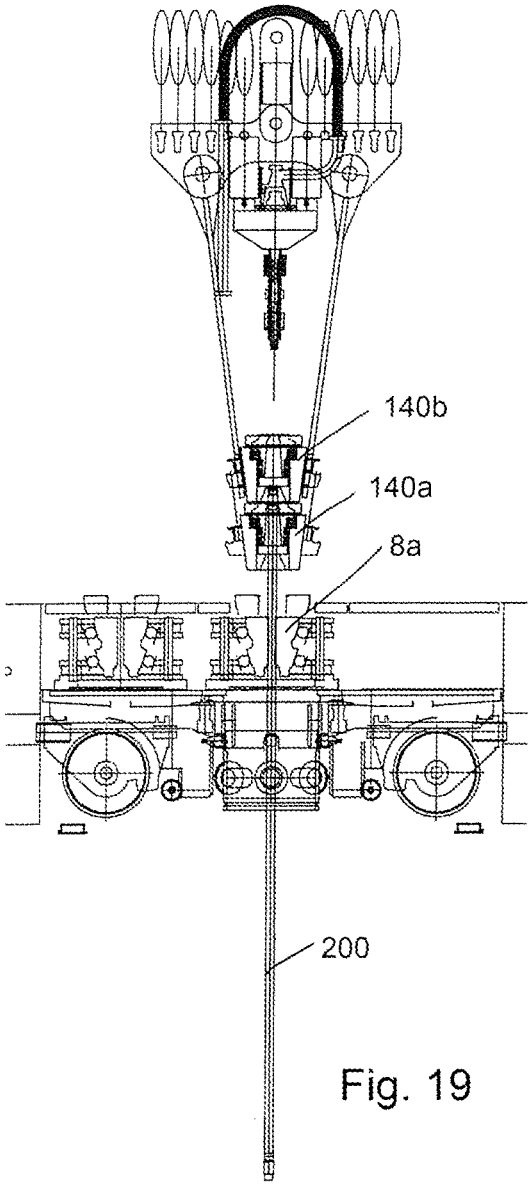
FIG. 19 illustrates moving the first slip device into the operational position thereof, engaging said first slip device with the drilling tubulars string, and transferring the load of the drilling tubulars string onto the first slip device.
Figure 20:
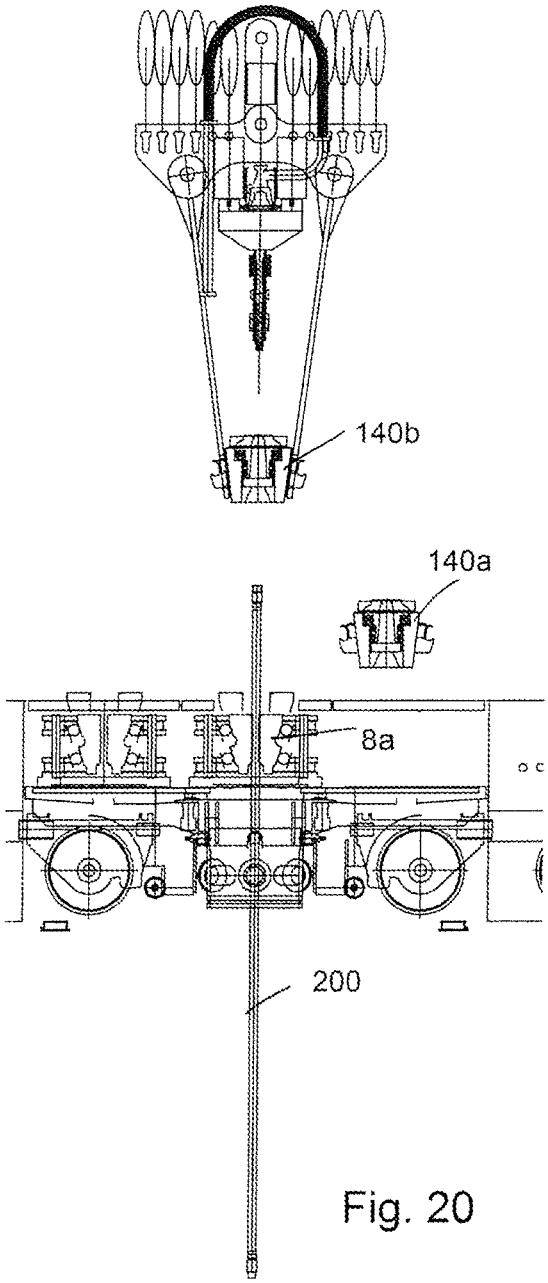
FIG. 20 illustrates disengaging the first diameter rotatable head clamp component from the drilling tubulars string, releasing the first diameter rotatable head clamp component from the trolley, and moving said first diameter rotatable head clamp from the firing line.

Once the components 140*a* and 140*b* have been interconnected, it is envisaged that the trolley 10 is moved upwards and, as shown in FIG. 18, the second and first diameter rotatable head clamp components 140*b*, a as well as the drilling tubulars string section 200. This lifting step is performed to allow for the slip device 8*a* to be returned into its active or operative position aligned with the firing line 5 as shown in FIG. 19.

One the first slip device 8*a* has been moved into the operational position thereof, the lateral door thereof is closed and the clamping members thereof are engaged with the drilling tubulars string section 200. This is shown in FIG. 19 and the load of the drilling tubulars string can now be transferred from the trolley 10 onto the first slip device 8*a*.

Once the slip device 8*a* carries the firing line load, the first diameter rotatable head clamp component 140*a* can be disengaged from the drilling tubulars string by actuation of the lever members and the trolley can be slightly lifted to clear the component 140*a* from the top end of the string section 200. Again using a non-depicted cart, or in some other manner, the component 140*a* can be released from the trolley 10, e.g. by lowering the component 140*a* onto the cart, releasing the members 17*a*, 18*a*, and moving the component 140*a* away from, e.g. to a remote storage. This is illustrated schematically in FIG. 20.

Now the switch to the second diameter tubulars is made, with the second diameter being greater than then first diameter, e.g. in view of the assembly and use of a tapered drill string in a wellbore drilling process.

Figure 21:
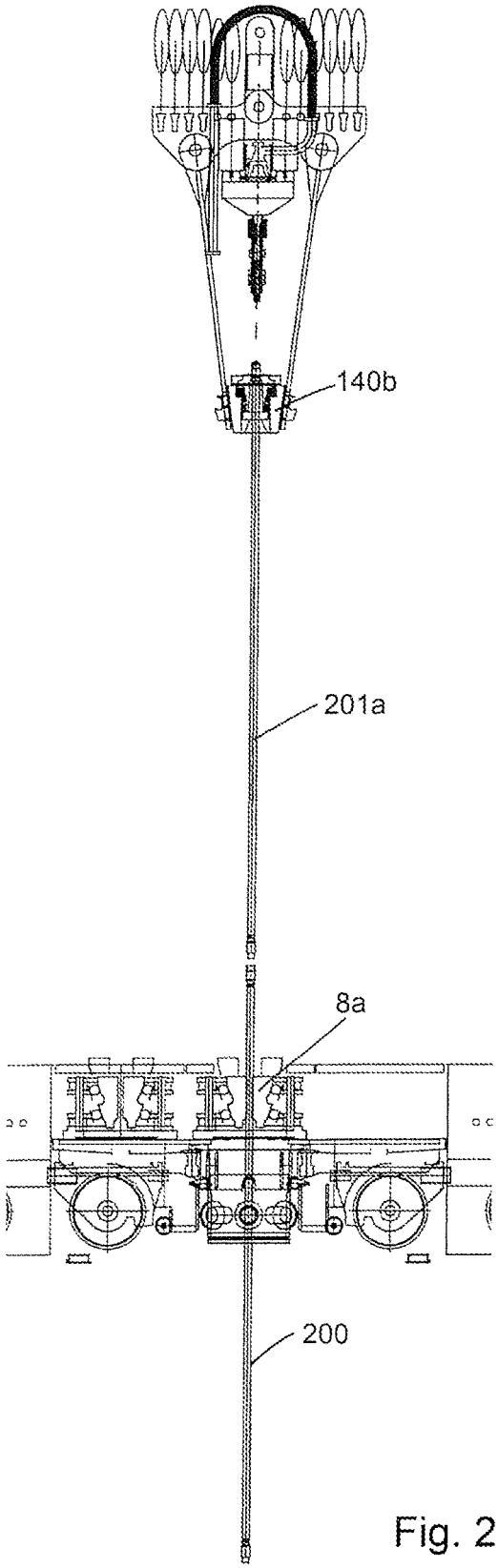
FIG. 21 illustrates arranging a second diameter tubular in the firing line and suspending said second diameter tubular from the second diameter rotatable head clamp component.

The FIG. 21 illustrates arranging a second diameter tubular 201*a* in the firing line 5 above the suspended first diameter section 200. As will be appreciated this tubular 201 can be a single or multi-joint stand taken out of one of the storage devices 110, 120. In practical use, the tubular 201*a* can include at its lower end, or even be limited to, a drill string sub, so a rather short piece, having a first diameter (threaded) connection portion at its lower end and a second diameter (threaded) connection portion at its upper end.

The FIG. 21 also illustrates that this second diameter tubular 201*a* is suspended from the second diameter rotatable head clamp component 140*b*, e.g. by lowering the trolley somewhat and/or raising the motion arms acting as pipe racker device, in order to pass the top end portion of the tubular 201*a* through the passage of the component 140*b* so that the retention members thereof can engage, e.g. on the tool joint or box member thereof. As discussed the top of the tubular 201*a* can be temporarily provided with a sub dedicated to engagement with the retention members of the head clamp component 140*b*. If desired, e.g. in view of make-up of the connection with the suspended section 200 and/or for providing torque in view of actual drilling, the top drive rotary stem 36 can be made to engage with the top end of the suspended second diameter tubular 201*a*, here by lowering the top drive 30 relative to the frame of the trolley.

Figure 22:
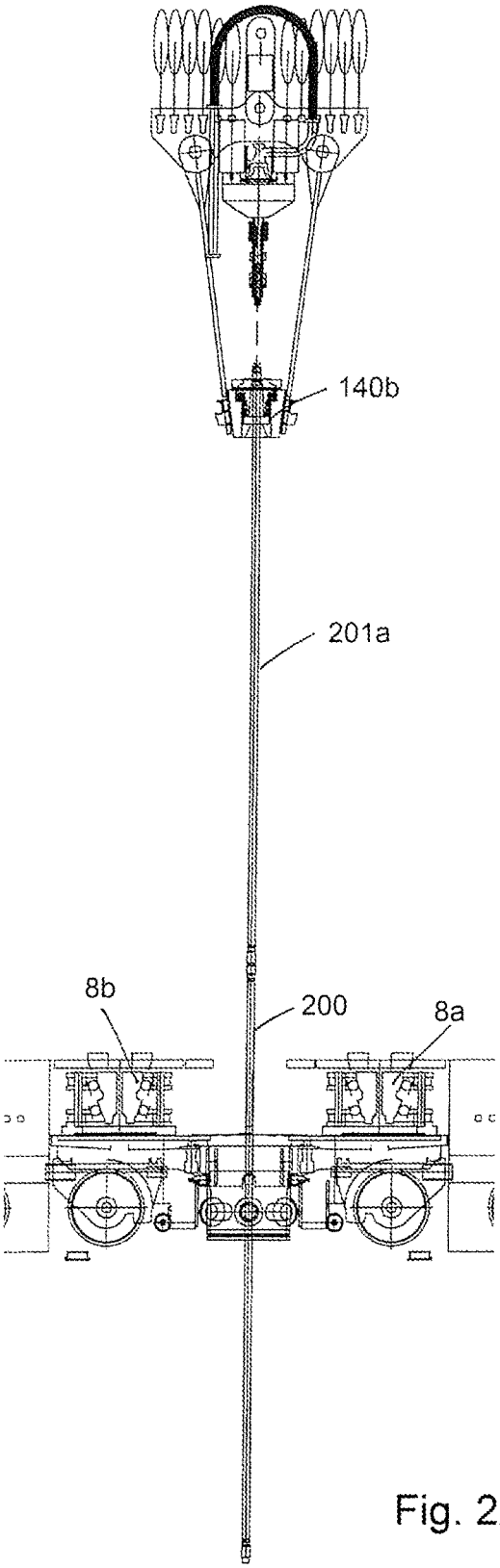
FIG. 22 illustrates, after having connected said second diameter tubular to the drilling tubulars string suspended from the first slip device and after having transferred the load of the drilling tubulars string from the first slip device onto the second diameter rotatable head clamp component, the releasing of the first slip device from the drilling tubulars string and the moving of said first slip device into the retracted position thereof.

Once the second diameter tubular 201*a* has been connected, e.g. using an iron-roughneck device, to the drilling tubulars string section 200 suspended from the first slip device 8*a*, the load can be transferred from the first slip device 8*a* onto the second diameter rotatable head clamp component 140*b*, e.g. by slightly raising the trolley 10. Now, as described before, the first slip device 8*a* can be released from the drilling tubulars string section 200 and the first slip device 8*a* can again be moved into the retracted position thereof. This is illustrated in FIG. 22. Now the entire drill string is suspended from the component 140*b* which includes a thrust bearing adapted to support said load and able to allow for rotation of the string, e.g. by the top drive 30, under said load.

Figure 23:
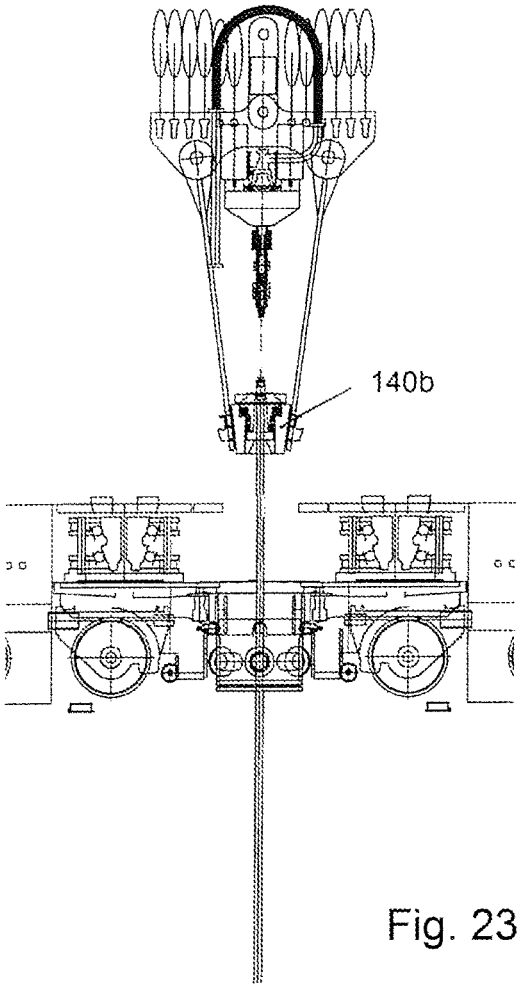
FIG. 23 illustrates the lowering the trolley and thereby the drilling tubulars string suspended from the second diameter rotatable head clamp component.

The FIG. 23 then illustrates the lowering of the trolley 10 and thereby the drilling tubulars string suspended from the second diameter rotatable head clamp component 140*b*, e.g. to a height so that the top end of the drill string is at the normal make-up position above the drill floor 2.

Figure 24:
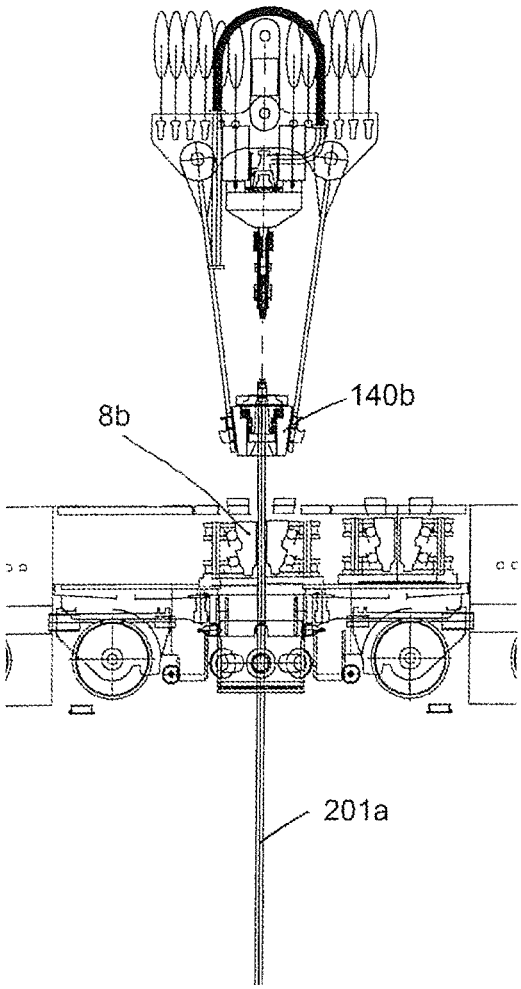
FIG. 24 illustrates the moving the second slip device into the operational position thereof, engaging said second slip device with the second diameter tubular of the drilling tubulars string, and transferring the load of the drilling tubulars string onto the second slip device.

As now the second diameter tubular 201*a* is at the height of the slip device system 8, the first slip device 8*a* (which was set at holding first diameter tubulars) is no longer of use. Yet the second slip device 8*b* is set to holding second diameter tubulars 201*a* and can now be employed. Therefore this second slip device 8*b* is brought into the operational position thereof. It will be appreciated that this can also be done somewhat earlier than shown here. Once the second slip device 8*b* is in operative position, the lateral door thereof has been closed, and the string has been lowered sufficiently, as shown in FIG. 24, the clamping members of the second slip device 8*b* are brought into engagement with the second diameter tubular 201*a* of the drilling tubulars string. Now the load can be transferred onto the second slip device 8*b*.

It will be appreciated that by having a slip system with two slip devices 8*a, b*, it is possible to minimize the loss of time that would otherwise be involved in changing the setting of a slip device to another diameter. Also, it allows for the use of slip devices 8*a, b* that have each have a different, possibly overlapping, and rather limited range of diameters to be handled by each of the slip devices. This brings along structural and wear related advantages for the slip devices, e.g. as a large diameter range is likely to introduce large internal loads within the slip device itself compared to a device having a smaller operational diameter range. Also, clamping members may be subjected to wear, or at least require inspection, with can now be done at leisure once the other slip device has been made operational.

Figure 25:
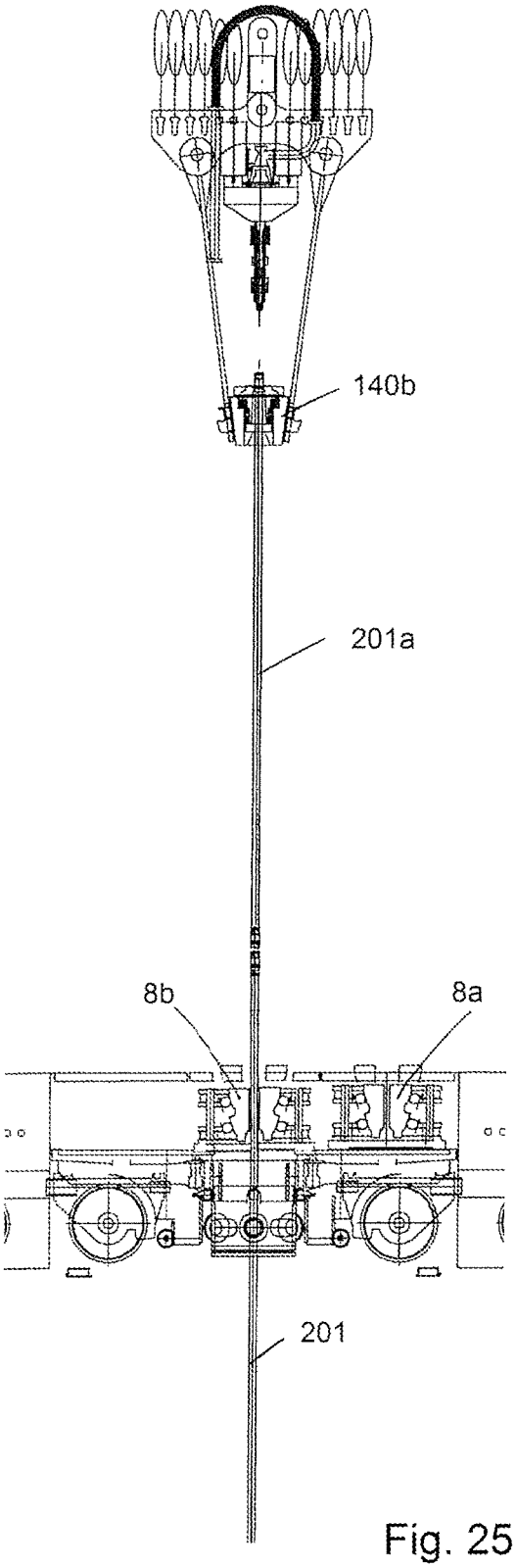
FIG. 25 illustrates the disengaging the second diameter rotatable head clamp component from the drilling tubulars string, the lifting the trolley and the second diameter rotatable head clamp component, and the arranging of a further second diameter tubular in the firing line and suspending said second diameter tubular from the second diameter rotatable head clamp component.

From this point onwards a practical method encompasses extending the second diameter section 201 of the tapered drilling tubular string by adding further tubulars 201*a*. The second diameter rotatable head clamp component 140*b* is disengaged from the drilling tubulars string, the trolley 10 and the second diameter rotatable head clamp component 140*b* are lifted over the height that allows for arranging of a further second diameter tubular 201*a* in the firing line, and this further second diameter tubular 201*a* is suspended from the second diameter rotatable head clamp component 140*b* as illustrated in FIG. 25.

Figure 26:
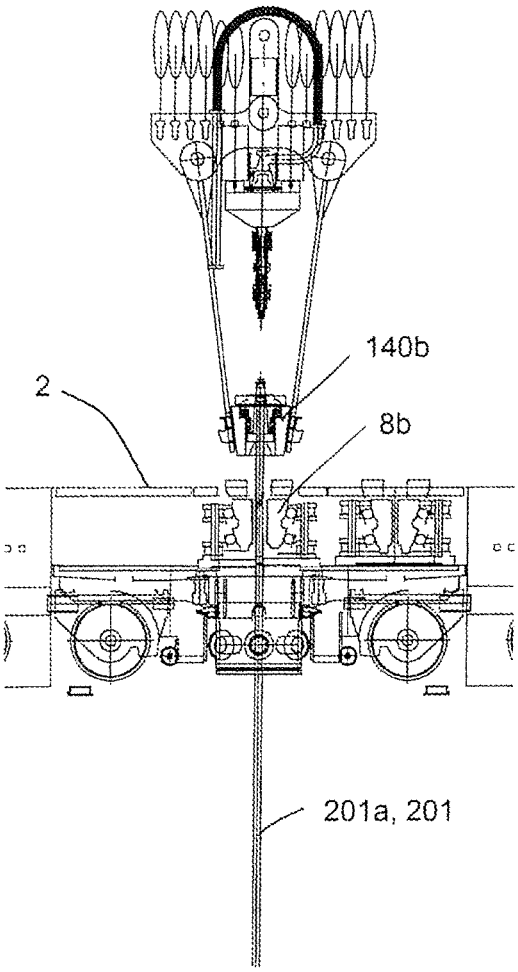
FIG. 26 illustrates, after having connected said further second diameter tubular to the drilling tubulars string suspended from the second slip device, the release of said second slip device from the drilling tubulars string, the lowering the trolley and thereby the drilling tubulars string, and the re-engagement of the second slip device with the drilling tubulars string and transfer the load of the drilling tubulars string onto the second slip device.

The FIG. 26 then depicts, after having connected this further second diameter tubular 201*a* to the drilling tubulars string suspended from the second slip device 8*b* and after the release of the second slip device 8*b* from the drilling tubulars string, the lowering the trolley 10 and thereby the drilling tubulars string to the designated make-up position. Then the second slip device 8*b* is re-engaged with the drilling tubulars string and the load of the drilling tubulars string is transferred onto the second slip device 8*b*. The last sequence of step is repeated until the second diameter section 201 has reached the desired length.

It will be appreciated that the described installation and method also allow for a tapered drilling tubulars string having more than two different diameter sections, e.g. with the first diameter slip device 8*a* being set to a third diameter during the assembly of the second diameter section or the replacement thereof by a third slip device adapted to the third diameter. Also a third head clamp component could be envisaged to be of use in the assembly of a third diameter drill string section.

The invention claimed is:

1. A wellbore drilling installation for drilling a wellbore or other wellbore related activities, said installation comprising:

a drilling tower;

a drill floor having a well center through which a drilling tubulars string is passable along a firing line into the wellbore;

a slip device system in or on said drill floor, said slip device system comprising at least one slip device, each slip device being adapted to clamp onto and support the drilling tubulars string, each slip device being movable between an operational position thereof that is aligned with the firing line and a respective retracted position that is remote from the firing line, each slip device having a lateral opening allowing to disengage the slip device in the operational position thereof from the drilling tubulars string in the firing line and move the slip device into the respective retracted position and vice versa;

a trolley that is vertically guided relative to said drilling tower;

a main hoisting device that is adapted to lift and lower said trolley; and a top drive device attached to the trolley, said top drive device comprising one or more top drive motors and a rotary stem that is driven by said one or more top drive motors in order to impart a rotary motion to the drilling tubulars string when connected to the rotary stem of said top drive device, wherein the trolley comprises a frame that is suspended from said main hoisting device, wherein said frame comprises one or more vertical load bearing frame members adapted to support a drilling tubulars string load of the drilling tubulars string that passes along said firing line into the wellbore, wherein said top drive device is attached to the frame of the trolley independent from said one or more vertical load bearing frame members, such that said drilling tubulars string load is transmitted to the main hoisting device via said one or more vertical load bearing frame members bypassing the top drive device, wherein said installation further comprises one or more components that are each adapted to be releasably connected to and suspended from said one or more vertical load bearing frame members of the trolley, said one or more components at least including:

a rotatable head clamp component, which comprises:

a housing provided with one or more connector members that are adapted to be connected to the one or more vertical load bearing frame members of the trolley in order to suspend the rotatable head clamp component from the trolley;

an open-centered rotary body with a vertical passage there through that at least allows to lower the head clamp component from above over a top end of a drilling tubular that is held in said firing line by said at least one slip device of said slip device system;

a retainer assembly on said open-centered rotary body, which retainer assembly is embodied to axially retain said top end of the drilling tubular, whilst the top end of the drilling tubular remains accessible for the rotary stem of the top drive device, and which retainer assembly is embodied to support the drilling tubulars string load; and a drilling operation thrust bearing that is arranged between said housing and said rotary body and that is adapted to support the drilling tubulars string load exerted on the rotary body by a drilling tubulars string suspended by the retainer assembly from the rotatable head clamp component during a drilling operation, and wherein said wellbore drilling installation is embodied such that, with each slip device in respective retracted position, the rotatable head clamp component, whilst suspended from said one or more vertical load bearing frame members of the trolley, is lowerable by means of the trolley onto a support structure that is arranged in or on the drill floor, which support structure is adapted to support the drilling tubulars string load of a drilling tubulars string retained by said rotatable head clamp component.

2. The wellbore drilling installation according to claim 1, wherein said slip device system comprises a first slip device and a second slip device, each slip device being adapted to clamp onto and support the load of the drilling tubulars string, each slip device being movable between the operational position thereof aligned with the firing line and the respective retracted position remote from the firing line, said respective retracted positions of said first and second slip devices being on opposite sides from the firing line, each of said first and second slip devices having said respective lateral opening allowing to disengage the slip device in the operational position thereof from the drilling tubulars string in the firing line and move the slip device into its respective retracted position and vice versa, and wherein the wellbore drilling installation is embodied such that, with each of said first and second slip devices in respective retracted position, the rotatable head clamp component, whilst suspended from said one or more vertical load bearing frame members of the trolley, is lowerable by means of the trolley onto said support structure in a position thereof in between the first and second retracted slip devices.

3. The wellbore drilling installation according to claim 1, wherein the drill floor has a recessed well center space, and wherein one or more rails are arranged in said recessed well center space, wherein said first slip device and said second slip device are mounted on said one or more rails to each be displaceable between the operational position thereof aligned with the firing line and the respective retracted position remote from the firing line.

4. The wellbore drilling installation according to claim 1, wherein the installation comprises:

a first rotatable head clamp component adapted or set to handle first diameter drilling tubulars;

a second rotatable head clamp component adapted or set to handle second diameter drilling tubulars; and additional link members adapted to suspend one of said first and second rotatable head clamp components from the other one of said first and second rotatable head clamp components.

5. The wellbore drilling installation according to claim 1, wherein the installation comprises one or more carts, each cart being adapted to transport a respective one of said one or more components to be suspended from the first and one or more vertical load bearing frame members, wherein each cart is adapted to be positioned on the drill floor underneath the trolley.

6. The wellbore drilling installation according to claim 1, wherein the drilling tower is provided with at least one vertical trolley rail, and wherein said trolley is guided along said at least one vertical trolley rail.

7. The wellbore drilling installation according to claim 1, wherein the main hoisting device comprises one or more winch driven cables from which said trolley is suspended.

8. The wellbore drilling installation according to claim 1, wherein the frame is provided with:

a top frame member suspended from said main hoisting device; and a first vertical frame member and a second vertical frame member forming said vertical load bearing frame members of the trolley frame, wherein said first vertical frame member and said second vertical frame member are each connected at an upper end thereof to said top frame member, said first and second vertical frame members depending from said top frame member spaced apart from one another and being adapted to support the drilling tubulars string load, wherein each of said first and second vertical frame members comprises a lower connector member that is adapted to be connected to at least said rotatable head clamp component, and wherein said top drive device is attached to the frame of the trolley independent from the first and second vertical frame members.

9. The wellbore drilling installation according to claim 1, wherein the slip device system is arranged in a recessed well center in the drill floor, and wherein the wellbore drilling installation is embodied such that, with each slip device in respective retracted position in said recessed well center, the rotatable head clamp component, whilst suspended from said one or more vertical load bearing frame members of the trolley, is lowerable by means of the trolley onto the support structure arranged in the recessed well center.

10. The wellbore drilling installation according to claim 1, further comprising a cart embodied to travel over rails on the drill floor, wherein the cart is positionable on the drill floor over the well center and underneath the trolley.

11. A method for operating the wellbore drilling installation according to claim 1, comprising the step of:

with each slip device in respective retracted position, lowering the rotatable head clamp component, whilst suspended from said one or more vertical load bearing frame members of the trolley, by means of the trolley onto the support structure in or on the drill floor, which support structure is adapted to support the drilling tubulars string load of the drilling tubulars string retained by said rotatable head clamp component.

12. The method of claim 11, wherein the method comprises, after the rotatable head clamp component supporting the drilling tubulars string has been lowered onto the support structure in or on the drill floor, the step of providing torque to said drilling tubulars string in order to impart rotary motion thereof by a drive motor distinct from the top drive device attached to the trolley.

13. The method of claim 11, wherein the method comprises, after the rotatable head clamp component supporting the drilling tubulars string has been lowered onto the support structure in or on the drill floor, the step of positioning a cart on the drill floor over the well center and underneath the trolley.

14. The method of claim 13, wherein the method comprises the step of disconnecting the top drive device from the trolley and arranging the top drive device onto the cart, and the step of moving the cart with the top drive device away from the well center.

15. A method for operating a wellbore drilling installation according to claim 1, wherein a tapered drill string is assembled comprising a first drill string section composed of first diameter tubulars and a second drill string section composed of second diameter tubulars, and said slip device system comprises a first slip device and a second slip device, wherein the method comprises:

a) keeping the first drill string section composed of the first diameter tubulars suspended in the firing line by means of the first slip device;

b) suspending, above said first drill string section, a further first diameter tubular from a first diameter rotatable head clamp component that is adapted to axially retain the top end of the first diameter tubular and that is connected to the trolley;

c) connecting said further first diameter tubular to said suspended first drill string section;

d) releasing said first slip device from the first drill string section and moving said first slip device in the retracted position thereof;

e) lowering the trolley and thereby the first drill string section suspended from the first diameter rotatable head clamp component, until the first diameter rotatable head clamp component is in a position in between the first and second slip devices and is resting on the support structure that is adapted to support the load of string retained by said first diameter rotatable head clamp component;

f) disconnecting the first diameter rotatable head clamp component from the trolley;

g) arranging a second diameter rotatable head clamp component in the firing line above the first diameter rotatable head clamp component and suspending said second diameter rotatable head clamp component from the trolley;

h) securing said first diameter rotatable head clamp component to said trolley;

i) lifting the trolley and thereby the second and first diameter rotatable head clamp components as well as the drilling tubulars string;

j) moving the first slip device into the operational position thereof, engaging said first slip device with the drilling tubulars string, and transferring the load of the drilling tubulars string onto the first slip device;

k) disengaging the first diameter rotatable head clamp component from the drilling tubulars string, releasing the first diameter rotatable head clamp component from the trolley, and moving said first diameter rotatable head clamp component from the firing line;

l) arranging a second diameter tubular in the firing line and suspending said second diameter tubular from the second diameter rotatable head clamp component;

m) connecting said second diameter tubular to the drilling tubulars string suspended from the first slip device;

n) transferring the load of the drilling tubulars string from the first slip device onto the second diameter rotatable head clamp component, releasing the first slip device from the drilling tubulars string, and moving said first slip device into the retracted position thereof;

o) lowering the trolley and thereby the drilling tubulars string suspended from the second diameter rotatable head clamp component;

p) moving the second slip device into the operational position thereof, engaging said second slip device with the second diameter tubular of the drilling tubulars string, and transferring the load of the drilling tubulars string onto the second slip device;

q) disengaging the second diameter rotatable head clamp component from the drilling tubulars string, and lifting the trolley and the second diameter rotatable head clamp component;

r) arranging a further second diameter tubular in the firing line and suspending said second diameter tubular from the second diameter rotatable head clamp component;

s) connecting said further second diameter tubular to the drilling tubulars string suspended from the second slip device;

t) releasing said second slip device from the drilling tubulars string, lowering the trolley and thereby the drilling tubulars string, re-engaging the second slip device with the drilling tubulars string and transferring the load of the drilling tubulars string onto the second slip device; and repeating the steps r, s, and t to complete a second section of the drilling tubulars string composed of second diameter tubulars.

* * * * *